US007219976B2

(12) United States Patent
Mori et al.

(10) Patent No.: US 7,219,976 B2
(45) Date of Patent: May 22, 2007

(54) WIPING DEVICE, DROPLET DISCHARGE DEVICE, ELECTRO-OPTICAL DEVICE, METHOD FOR MANUFACTURING AN ELECTRO-OPTICAL DEVICE, AND ELECTRONIC EQUIPMENT

(75) Inventors: Toshimasa Mori, Suwa-gun (JP); Kazuyoshi Fujimori, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 312 days.

(21) Appl. No.: 11/059,533

(22) Filed: Feb. 17, 2005

(65) Prior Publication Data

US 2005/0185016 A1 Aug. 25, 2005

(30) Foreign Application Priority Data

Feb. 24, 2004 (JP) ..... 2004-048499

(51) Int. Cl.
*B41J 2/165* (2006.01)
*B41J 2/06* (2006.01)
*B41J 2/085* (2006.01)

(52) U.S. Cl. ..... 347/33; 347/55; 347/76

(58) Field of Classification Search ..... 347/21, 347/22, 28, 33, 55, 76, 36, 77
See application file for complete search history.

(56) References Cited

U.S. PATENT DOCUMENTS 4,947,190 A * 8/1990 Mizusawa et al. ..... 347/33
5,589,865 A * 12/1996 Beeson ..... 347/28
6,168,259 B1 * 1/2001 Capurso ..... 347/36
6,382,767 B1 * 5/2002 Greive ..... 347/30
6,623,113 B2 * 9/2003 Yamada et al. ..... 347/77
6,692,100 B2 * 2/2004 Steinfield et al. ..... 347/22
6,866,362 B2 * 3/2005 Kimura et al. ..... 347/33
7,073,886 B2 * 7/2006 Nakamura ..... 347/33

FOREIGN PATENT DOCUMENTS

| | | |
|---|---|---|
| CN | 1288416 A | 3/2001 |
| CN | 1396005 A | 2/2003 |
| CN | 1413833 A | 4/2003 |
| JP | A 2001-171135 | 6/2001 |
| JP | A-2003-24835 | 1/2003 |
| JP | A-2003-127405 | 5/2003 |
| WO | 00/38930 A1 | 7/2000 |

* cited by examiner

*Primary Examiner*—Shih-Wen Hsien
(74) *Attorney, Agent, or Firm*—Oliff & Berridge, PLC

(57) ABSTRACT

A wiping unit is provided that wipes a droplet discharge head included in a droplet discharge unit and reduces the likelihood or prevents a cleaner to be sprayed to a wiping sheet from getting dispersed and adhering to peripheral units. A wiping unit included in a droplet discharge unit is provided with a charged electrode, an absorption electrode, and a static elimination brush. A cleaner sprayed by a cleaner spray head is electrically charged by the charged electrode. The charged cleaner is absorbed toward the absorption electrode, and adheres to a wiping sheet that is placed just before the absorption electrode. Accordingly, it is possible to reduce the likelihood or prevent the cleaner from getting dispersed and adhering to peripheral units.

10 Claims, 33 Drawing Sheets

WIPING DEVICE, DROPLET DISCHARGE DEVICE, ELECTRO-OPTICAL DEVICE, METHOD FOR MANUFACTURING AN ELECTRO-OPTICAL DEVICE, AND ELECTRONIC EQUIPMENT

BACKGROUND

Exemplary aspects of the present invention relate to a wiping device of a droplet discharge head represented by an inkjet head fitted in a droplet discharge device (lithography device), a droplet discharge device fitted with the wiping device, an electro-optical device, a method for manufacturing an electro-optical device, and electronic equipment.

A related art wiping device includes a wiper unit and a sheet feeder unit. The wiper unit is fitted with a pressure member that presses a wiping sheet relatively on a nozzle surface of a droplet discharge head. The sheet feeder unit feeds the wiping sheet via the pressure member. With the wiping sheet pressed onto the nozzle surface, the wiper unit moves together with the sheet feeder unit in a predetermined wiping direction parallel to the nozzle surface, while feeding the wiping sheet, so as to wipe the nozzle surface with the wiping sheet. See Japanese Unexamined Patent Publication No. 2001-171135 (Page 4, FIG. 2).

This device applies a cleaner including a functional liquid solvent by dropping the cleaner from a plurality of cleaner discharge nozzles arranged side by side in a position facing the wiping sheet.

In order to effectively clean the droplet discharge head, the cleaner is preferably applied to the wiping sheet evenly on an applied area. In order to apply a cleaner evenly on an applied area, the cleaner is sprayed to the applied area of the wiping sheet with a cleaner spray nozzle.

SUMMARY

In this case, however, part of the cleaner sprayed from the cleaner spray nozzle fails to be applied to the wiping sheet and gets dispersed and adheres to peripheral units, such as the droplet discharge head and the sheet feeder unit, other than the wiping sheet. As a result, the cleaner is wasted and adversely affects the device depending on properties of the solvent used as the cleaner.

Accordingly, exemplary aspects of the present invention to provide a wiping device, a droplet discharge device, an electro-optical device, a method for manufacturing an electro-optical device, and electronic equipment that are capable of making a cleaner be applied to an area of a wiping sheet.

A wiping device of one exemplary aspect of the present invention includes a wiping sheet that wipes a nozzle surface of a droplet discharge head, and cleaner sprayer that sprays and applies a cleaner to an applied area on the front surface of the wiping sheet prior to the wiping. The wiping device also includes a charged electrode that electrically charges a cleaner sprayed by the cleaner sprayer, and an absorption electrode that is provided on the back surface of the wiping sheet and corresponds to the charged electrode.

With this structure, the cleaner charged by the charged electrode is absorbed toward the absorption electrode placed on the back surface of the wiping sheet, and thus adheres to an applied area on the wiping sheet that corresponds to the absorption electrode.

In a case where the wiping sheet is required to have an applied area of a predetermined shape, the absorption electrode may have a plane shape corresponding to the shape.

The charged electrode is provided in unit with the cleaner sprayer. A voltage applied to the charged electrode and the absorption electrode may vary depending on required suction of the cleaner.

In this case, the wiping device may include a static eliminator that eliminates a static charge from the wiping sheet to which a cleaner is applied so as to prevent the nozzle surface of the droplet discharge head from being electrically charged.

With this structure, even if the cleaner applied on the wiping sheet is not neutralized by the absorption electrode, the static eliminator completely removes electrical charges from the cleaner on the wiping sheet. Therefore, it is possible to reduce the likelihood prevent a circuit included in the droplet discharge head from being damaged by static charges, etc., caused by the charged cleaner applied on the wiping sheet while the nozzle surface of the droplet discharge head is wiped.

In this case, the width of the absorption electrode may be slightly smaller than the sheet width of the wiping sheet.

With this structure, it is possible to reduce the likelihood or prevent part of the charged cleaner from getting to the back area of the wiping sheet through a portion outside the sheet width of the wiping sheet and directly adhering to the absorption electrode.

In this case, the absorption electrode may be separated into a plurality of partial electrodes to each of which a voltage is applied individually.

With this structure, by selecting any one or plural desired partial electrodes, the charged cleaner is applied to an area on the wiping sheet corresponding to the shape of the selected electrode(s). Therefore, it is possible to set the shape and size of the applied area in accordance with the shape of an object to be wiped. For example, a plurality of droplet discharge head units with the different arrangement of their droplet discharge heads are replaceable. If the cleaner is required to be applied in an area corresponding to the position of the nozzle of each droplet discharge head unit, it can be easily achieved by selecting any of the plurality of electrodes that have been arranged in advance.

In order to select and wipe any of the plurality of droplet discharge heads, it is possible to selectively apply the cleaner to the area of the wiping sheet corresponding to the droplet discharge head to be wiped as long as the partial electrodes are arranged correspondingly to each droplet discharge head. Since the cleaner is not sprayed and applied to the area of the wiping sheet that is not used for wiping, it is possible not only to reduce the amount of the cleaner used (sprayed), but also to reduce the amount of the cleaner getting dispersed.

In this case, the charged electrode may be roughly ring shaped surrounding a cleaner that has been sprayed.

With this structure in which the cleaner sprayed by the cleaner spray nozzle passes through the roughly ring-shaped charged electrode, it is possible to evenly and efficiently charge the cleaner.

A droplet discharge unit of another exemplary aspect of the present invention includes the wiping device, the droplet discharge head that discharges a functional-liquid droplet to a work, and an X-Y moving mechanism that relatively moves a work to the droplet discharge head in an X-axis direction and a Y-axis direction.

With this structure, it is possible to keep the nozzle surface of the droplet head free from stains with the wiping device, and thereby maintaining stable functional-liquid discharge and highly accurate lithography. Moreover, it is possible to reduce the likelihood or prevent the cleaner from staining peripheral units.

In an electro-optical device of another exemplary aspect of the present invention, a film-forming part is provided by discharging a functional-liquid droplet to a work from the droplet discharge head by using the droplet discharge unit.

In a method for manufacturing an electro-optical device of another exemplary aspect of the present invention, a film-forming part is provided by discharging a functional-liquid droplet to a work from the droplet discharge head by using the droplet discharge unit.

With this structure, it is possible to keep the nozzle surface of the droplet head free from stains with the wiping device, and thereby manufacturing a highly reliable electro-optical device.

Examples of the electro-optical device may include a liquid crystal display, an organic electroluminescence (EL) device, an electron-emitting device, a plasma display panel (PDP) device, and an electrophoresis display. Here, the electron-emitting device denotes a concept including a so-called field emission display (FED) and surface-conduction electron-emitter display (SED). Examples of other electro-optic devices may include metal wiring forming, lens forming, resist forming, and light diffuser forming devices. A transparent electrode (ITO) forming device included in a liquid crystal display, etc., can also be included.

Electronic equipment of another exemplary aspect of the present invention is fitted with the electro-optical device or an electro-optical device manufactured by the method for manufacturing an electro-optical device.

In this case, examples of the electronic equipment may include a cellular phone, a personal computer, and various electrical products that are fitted with a so-called flat panel display.

As mentioned above, the present invention makes it possible to adjust the amount of a cleaner applied to the wiping sheet to wipe the nozzle surface of the droplet discharge head, and wipe the droplet discharge head with the wiping sheet on which the cleaner is evenly applied, and thereby efficiently wipe the droplet discharge head in an optimum state.

Since the droplet discharge unit whose droplet discharge head is kept clean is used in the electro-optical device, the method for manufacturing an electro-optical device, and the electronic equipment according to exemplary aspects of the present invention, it is possible to provide a highly reliable and quality electro optical device and electronic equipment.

BRIEF DESCRIPTION OF THE DRAWINGS

FIG. 14A shows a schematic of the electrostatic applying unit, whereas FIG. 14B shows a schematic showing the structure of the electrostatic applying unit seen from a cleaner spray head;

DETAILED DESCRIPTION OF EXEMPLARY EMBODIMENTS

Figure 1:
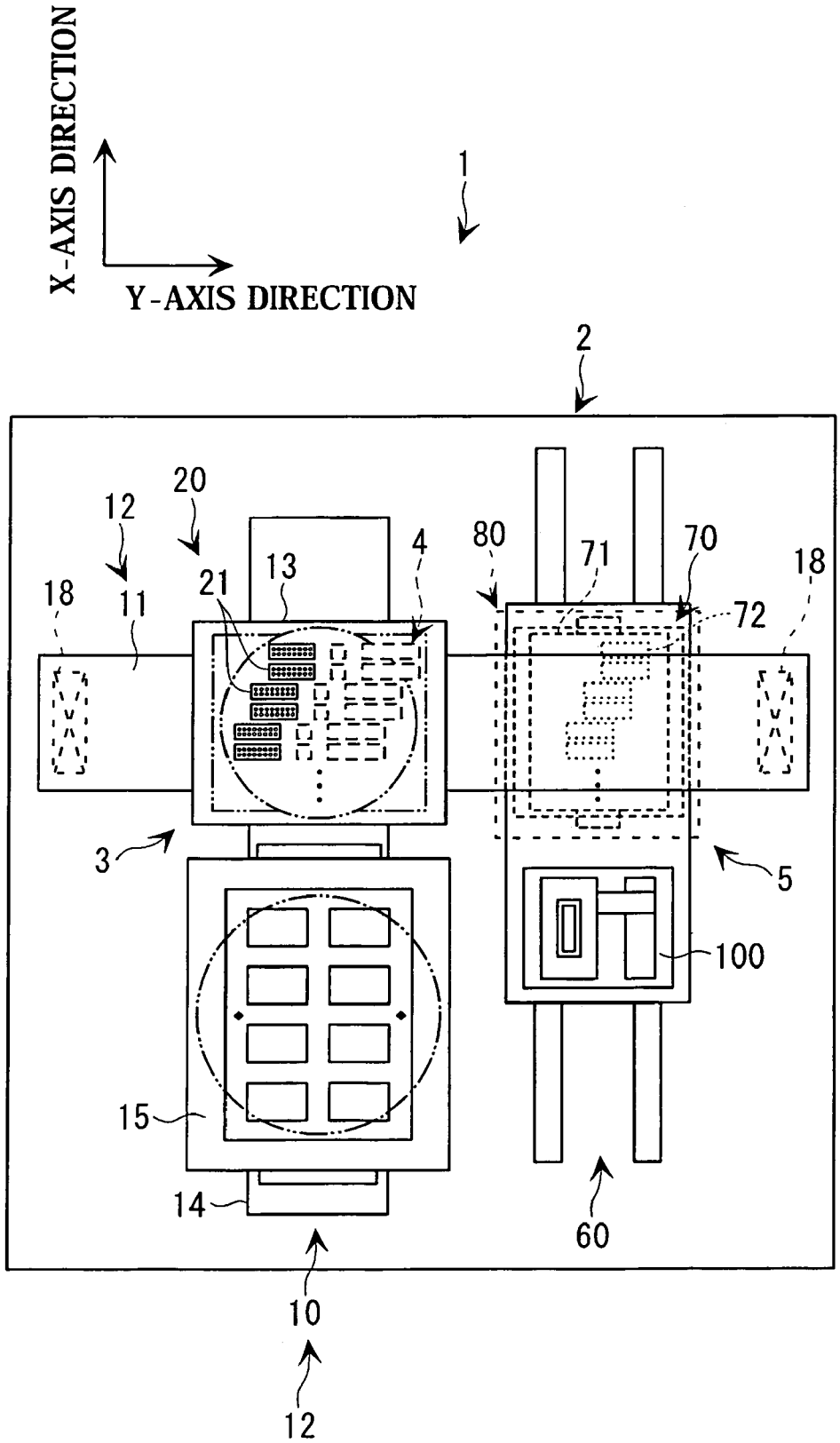
FIG. 1 is a schematic showing a lithography device of one exemplary embodiment of the present invention.
Figure 2:
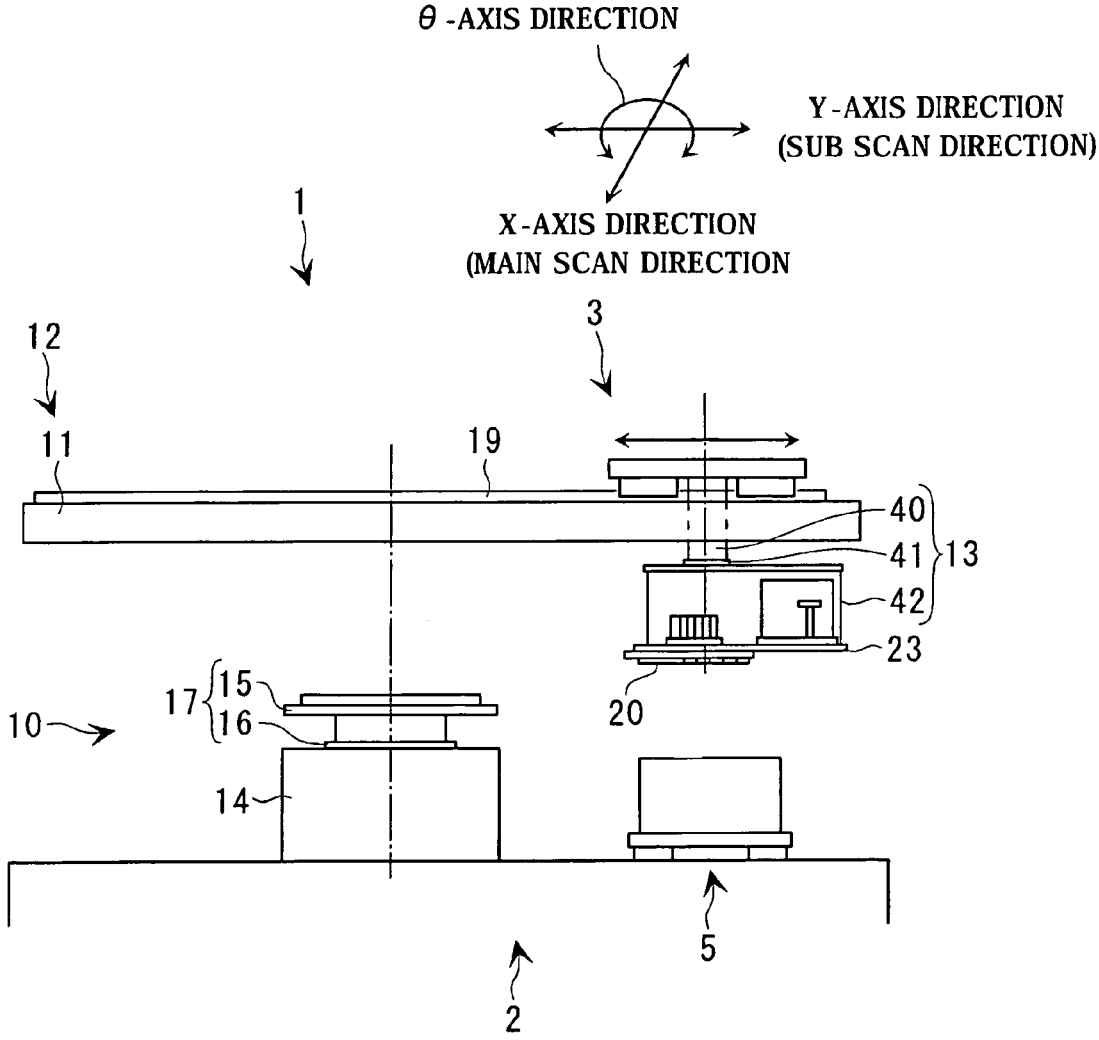
FIG. 2 is a schematic showing the lithography device of the embodiment.

Referring to FIGS. 1 and 2, a lithography device 1 includes a machine table 2, a droplet discharge unit 3, a functional liquid supply unit 4 and a head maintenance unit 5. The droplet discharge unit 3 has a droplet discharge head 21, and is placed on the whole area of the machine table 2. The functional liquid supply unit 4 is coupled to the droplet discharge unit 3. The head maintenance unit 5 is placed side by side with the droplet discharge unit 3 on the machine table 2. In the lithography device 1, based on the control of a controller provided outside the device of the drawing, the functional liquid supply unit 4 provides the droplet delivery unit 3 with a functional liquid. The droplet delivery unit 3 performs lithography processing for a work W. The head maintenance unit 5 performs maintenance on the droplet discharge head 21 as necessary.

The droplet discharge unit 3 includes a moving mechanism 12, a main carriage 13, and a head unit 20. The moving mechanism 12 is composed of an X-axis table 10 that makes the work W scan in the main direction (or move the work W in the X-axis direction), and a Y-axis table 11 that is perpendicular to the X-axis table 10. The main carriage 13 is movably mounted onto the Y-axis table 11. The head unit 20 is placed perpendicularly to the main carriage 13 and fitted with the droplet discharge head 21.

The X-axis table 10 includes a motor-driven X-axis slider 14 making up an X-axis direction driving system. The X-axis table 10 also includes a set table 17 composed of an absorption table 15 and a θ table 16, etc., and is movably mounted upon the X-axis slider 14. Similarly, the Y-axis table 11 includes a motor-driven Y-axis slider 19 making up a Y-axis direction driving system. The Y-axis table 11 also includes the main carriage 13 that is mounted movably in the Y direction upon the motor-driven Y-axis slider 19 to support the head unit 20. Here, the X-axis table 10 is arranged in parallel with the X-axis direction, and directly supported on the machine table 2. Meanwhile, the Y-axis table 11 is supported by a pair of columns 18 standing at each end of the machine table 2, and extends in the Y-axis direction over the X-axis table 10 and the head maintenance unit 5.

The head unit 20 includes the droplet discharge head 21 provided in plural number (for example twelve) and a head plate 22 on which the droplet discharge head 21 is mounted. The head plate 22 is removably supported by a support frame 23. The head unit 20 is aligned to the main carriage 13 with the support frame 23 therebetween. On the support frame 23, a tank unit 51 of the functional liquid supply unit 4 is also supported along with the head unit 20, which will be described in greater detail later (see FIG. 3).

Figure 4:
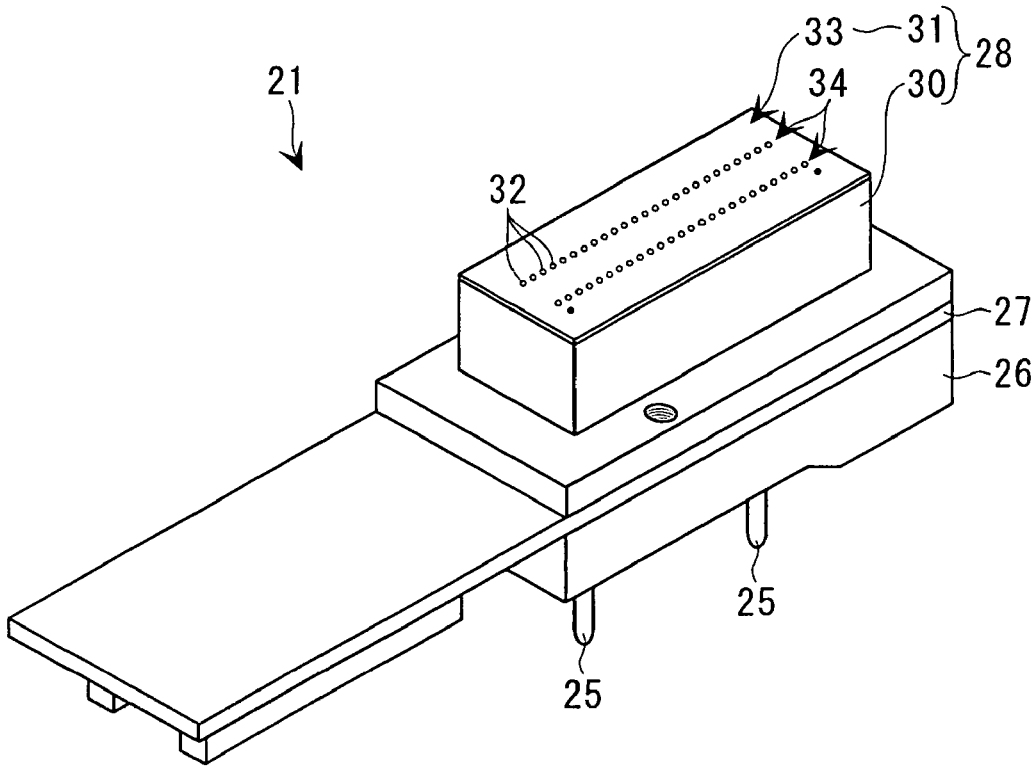
FIG. 4 is a schematic of a functional-liquid droplet discharge head.

Referring to FIG. 4, the droplet discharge head 21 includes a nozzle row 34 of two arrays, a functional liquid inlet part 26, a head substrate 27 of two arrays, and a head body 28. The functional liquid inlet part 26 has a coupling pin 25 of two arrays. The head substrate 27 is coupled to the functional liquid inlet part 26 and corresponds to the nozzle row 34. The head body 28 is coupled to the lower part of the functional liquid inlet part 26. Inside the head body 28, an in-head channel filled with a functional liquid is provided. The coupling pin 25 is coupled to the functional liquid supply unit not shown in the drawing and provides the in-head channel of the droplet discharge head 21 with a functional liquid.

The head body 28 includes a cavity 30 (piezoelectric element) and a nozzle plate 31. The nozzle plate 31 has a nozzle surface 33 having openings that are a number of (for example one-hundred and eighty) discharge nozzles 32. When the droplet discharge head 21 is driven for discharge, the head body 28 discharges a functional-liquid droplet from the discharge nozzles 32 by the pumping action of the cavity 30.

Figure 3:
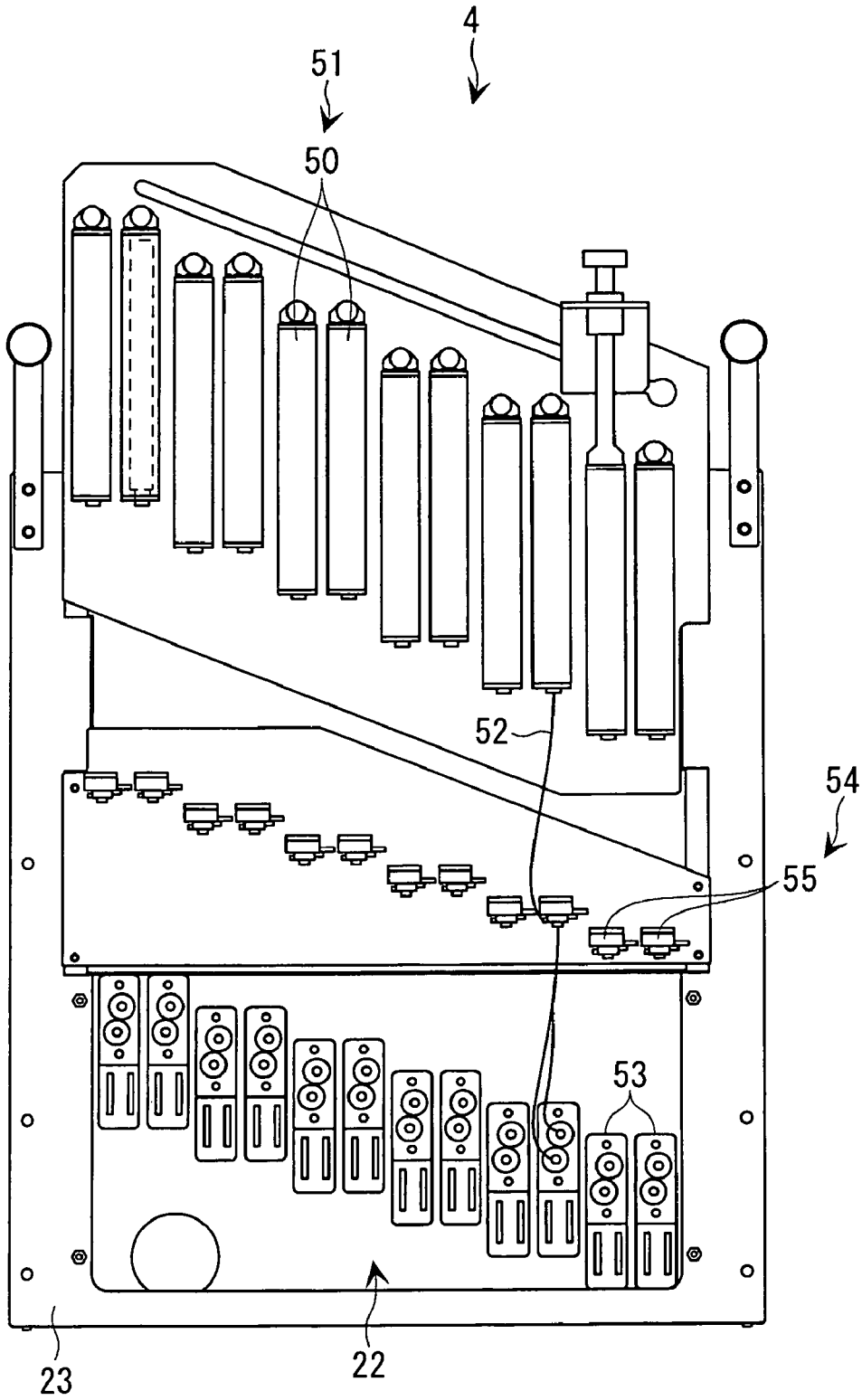
FIG. 3 is a schematic illustrating the structure of a head unit of the embodiment.

Referring to FIG. 3, the head plate 22 includes a thick square plate of stainless, for example. The head plate 22 is provided with twelve openings (not shown) for aligning twelve droplet discharge heads (each corresponding to the droplet discharge head 21) and fixing the heads with a head retaining member. Of the twelve openings, each two openings are grouped. The openings of each group are arranged in a direction perpendicular to the nozzle row of the droplet discharge head 21 (in the longitudinal direction of the head plate 22) so that they are partially overlapped. Specifically, each two of the twelve droplet discharge heads (each corresponding to the droplet discharge head 21) are grouped, and are arranged in a staircase pattern in the direction perpendicular to the nozzle row so that the nozzle row of the droplet discharge head 21 in each group is partially overlapped.

Referring to FIG. 2, the main carriage 13 includes an I-shaped suspended member 40, a θ rotating mechanism 41, and a carriage body 42. The suspended member 40 is fixed at its lower part on the Y-axis table 11. The θ rotating mechanism 41 is attached to the lower surface of the suspended member 40 so as to correct the position of the head unit 20 in the θ direction. The carriage body 42 is suspended from the lower part of the θ rotating mechanism 41 so as to support the head unit 20 with the support frame 23 therebetween. The carriage body 42 has a square opening (not shown) for freely fitting the support frame 23, and an alignment mechanism (not shown) for aligning the support frame 23 and aligning and fixing the head unit 20.

The functional liquid supply unit 4 is mounted on the support frame 23 with the head unit 20. The functional liquid supply unit 4 includes the tank unit 51, a plurality of (twelve) functional liquid supply tubes 52 and a plurality of (twelve) coupling parts 53. The tank unit 51 is composed of a plurality of (twelve) functional liquid tanks 50 to store a functional liquid. The functional liquid supply tubes 52 couple each of the functional liquid tanks 50 to each droplet discharge head 21 with a valve unit 54 composed of a voltage adjustment valve 55 therebetween. The coupling parts 53 couple each of the functional liquid supply tubes 52 to each of the functional liquid tanks 50 and each droplet discharge head 21.

The series operation of the lithography device 1 will now be briefly described. First, prior to lithography processing to discharge a functional liquid to a work, the position of the head unit 20 is corrected, and then the position of the work W set on the absorption table 15 is corrected. Next, the work W is moved back and forth in the main scan direction (in the X-axis direction) with the X-axis table 10, and the droplet discharge head 21 provided in a plural number is driven to selectively discharge a droplet to the work W. After the work W is moved back, the head unit 20 is moved to the sub scan direction (in the Y-axis direction) with the Y-axis table 11. Then, the work is moved back and forth again in the main scan direction and the droplet discharge head 21 is driven.

While the work W is moved in the main scan direction in the present exemplary embodiment, the head unit 20 may be moved in the main scan direction. Alternatively, the head unit 20 may be moved in the main scan direction (in the X-axis direction) and in the sub scan direction (in the Y-axis direction), while the work W is fixed.

Each element of the head maintenance unit 5 will now be described. The head maintenance unit 5 includes a moving table 60, an absorption unit 70 and a wiping unit (wiping device) 100. The moving table 60 is mounted upon the machine table 2 and extends in the X-axis direction. The absorption unit 70 is mounted upon the moving table 60 and absorbs a functional liquid from all nozzles of the droplet discharge head. The wiping unit 100 wipes the nozzle surface of the droplet discharge head. When the lithography processing is suspended, the head unit 20 is moved to a maintenance position that is the upper part of the machine table 2. With this state, the head unit 20 performs maintenance on the droplet discharge head 21 in various ways by selectively placing the absorption unit 70 and the wiping unit 100 directly under the head unit 20. In addition to the above-mentioned units, a discharge inspection unit to inspect the flying state of a liquid fluid droplet discharged from the droplet discharge head 21, a weight measurement unit to measure the weight of a liquid fluid droplet discharged from the droplet discharge head 21, etc., may be mounted upon the head maintenance unit 5.

Referring to FIGS. 1 and 2, the absorption unit 70 includes a cap stand 71, twelve caps 72 corresponding to the arrangement of the droplet discharge head 21, a single absorption pump (not shown) and an absorption tube (not shown). The caps 72 are supported by the cap stand 71, and attached firmly to the nozzle surface 33 of the droplet discharge head 21. The absorption pump is capable of absorbing twelve droplet discharge heads (each corresponding to the droplet discharge head 21) through each cap 72. The absorption tube couples each cap 72 and the absorption pump. Also, the cap stand 71 is provided with a cap lifting mechanism (not shown) to lift and lower each cap 72, and makes each cap 72 move from and to, the corresponding droplet discharge head 21 included in the head unit 20 that has been moved to a maintenance area.

In order to absorb the droplet discharge head 21, the cap lifting mechanism 75 is driven so as to make the caps 72 adhere closely to the nozzle surface 33 of the droplet discharge head 21, while the absorption pump 73 is driven. This processing creates suction on the droplet discharge head 21 via the caps 72. Accordingly, a functional liquid is forced to be absorbed from the droplet discharge head 21. Here, the functional liquid is absorbed to eliminate or prevent the clogging of the droplet discharge head 21 and to fill a functional liquid channel from the functional liquid tank 50 to the droplet discharge head 21 with a functional liquid when the lithography device 1 is initially set or the droplet discharge head 21 is replaced.

Note that the caps 72 have the function of a flushing box that receives a functional liquid discharged by the flushing of the droplet discharge head 21, and receive the functional liquid at periodical flushing for temporarily suspending the lithography processing for the work W in replacing the work W, for example. For the flushing, the cap lifting mechanism 75 is moved to a position so that the upper surface of the caps 72 is slightly separated from the nozzle surface 33 of the droplet discharge head 21.

The absorption unit 70 is also used to store the droplet discharge head 21 while the lithography device 1 does not operate. In this case, the head unit 20 is moved to the maintenance area 80, and the caps 72 are firmly attached to the nozzle surface 33 of the droplet discharge head 21. Accordingly, the nozzle surface 33 is sealed, and thereby reducing the likelihood or preventing the absorption nozzle 32 from clogging by reducing or preventing the drying of the droplet discharge head 21 (the absorption nozzle 32).

Figure 5:
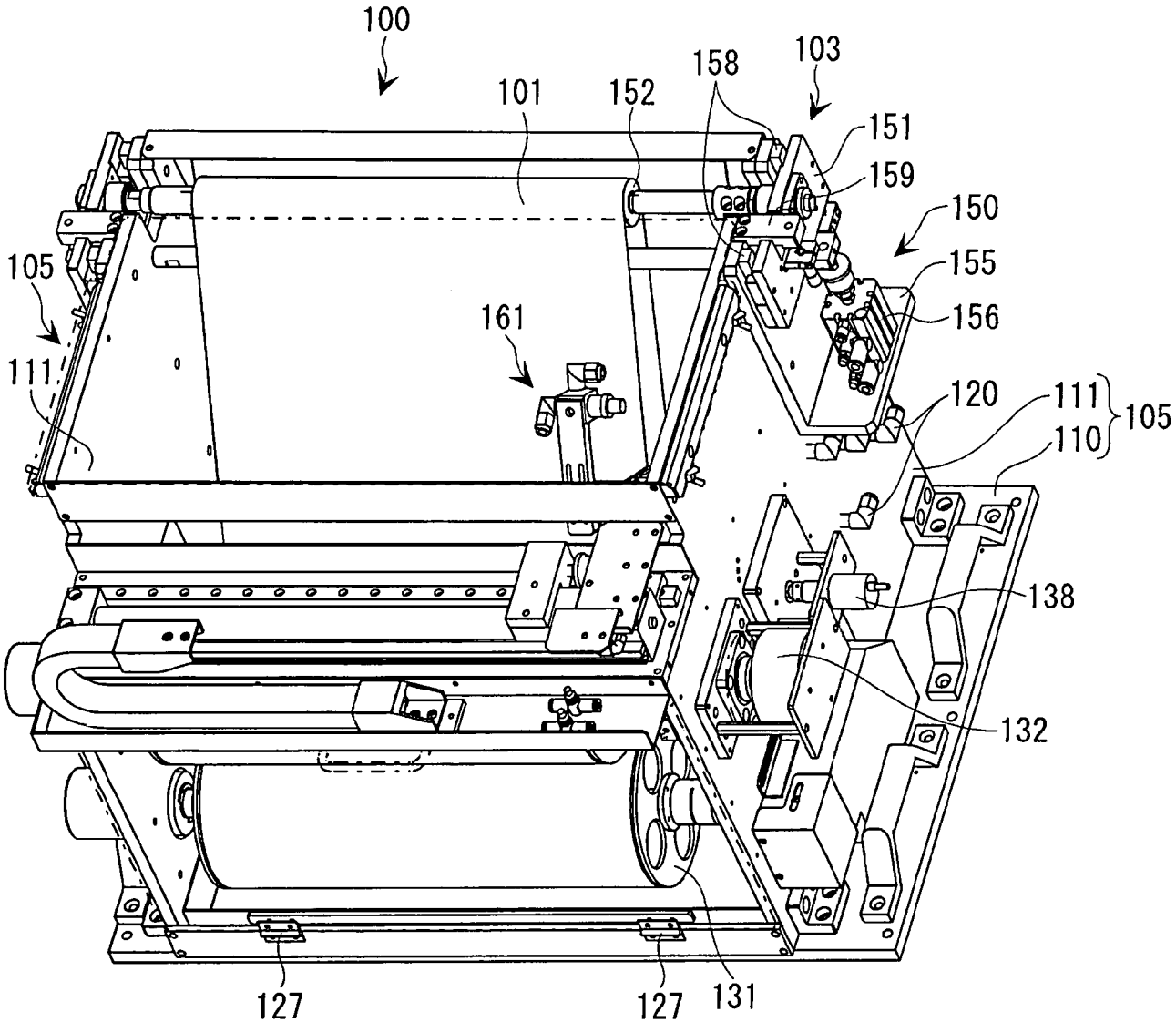
FIG. 5 is a schematic of a wiping unit of the embodiment.
Figure 6:
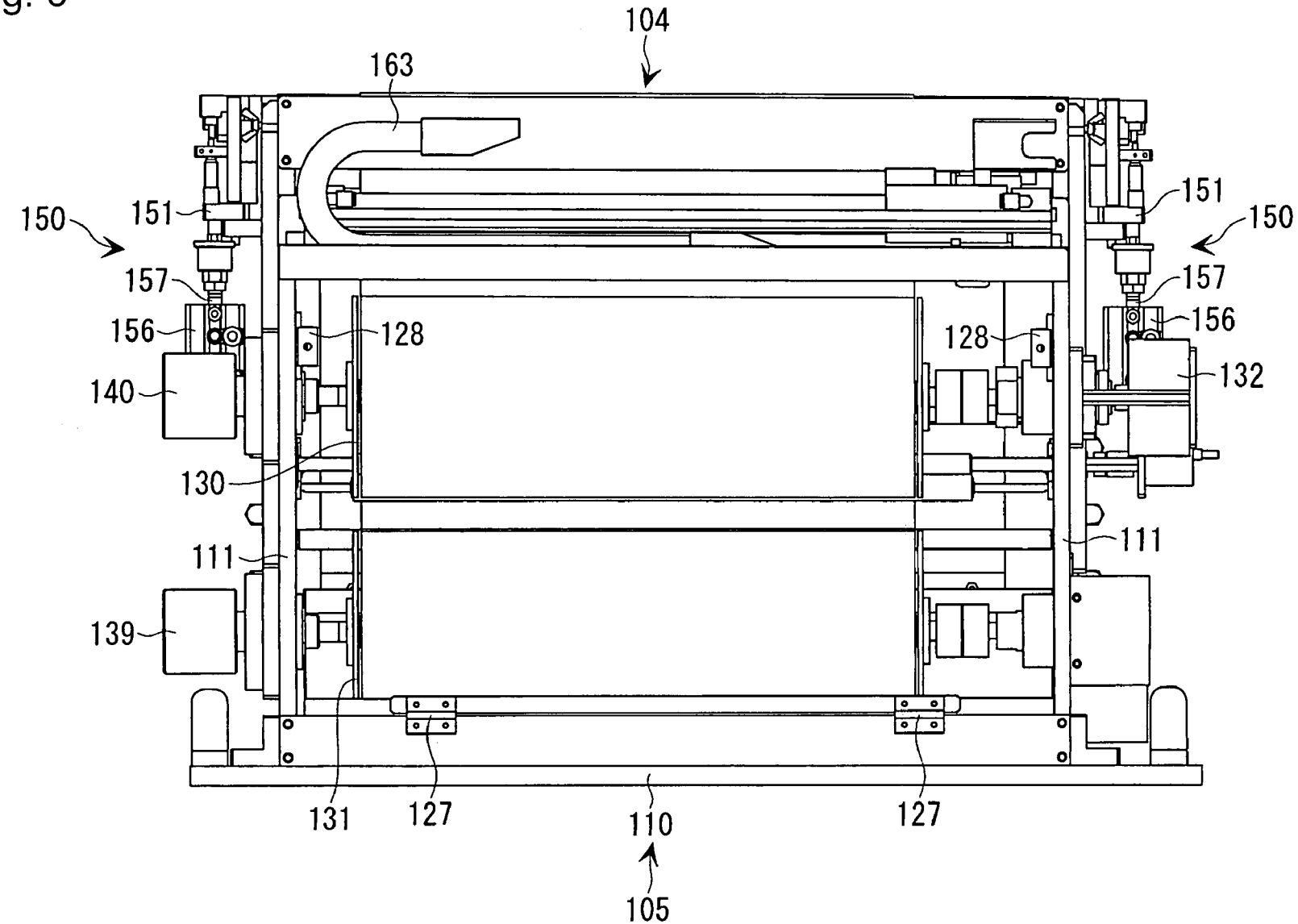
FIG. 6 is a schematic of the wiping unit of the embodiment.
Figure 7:
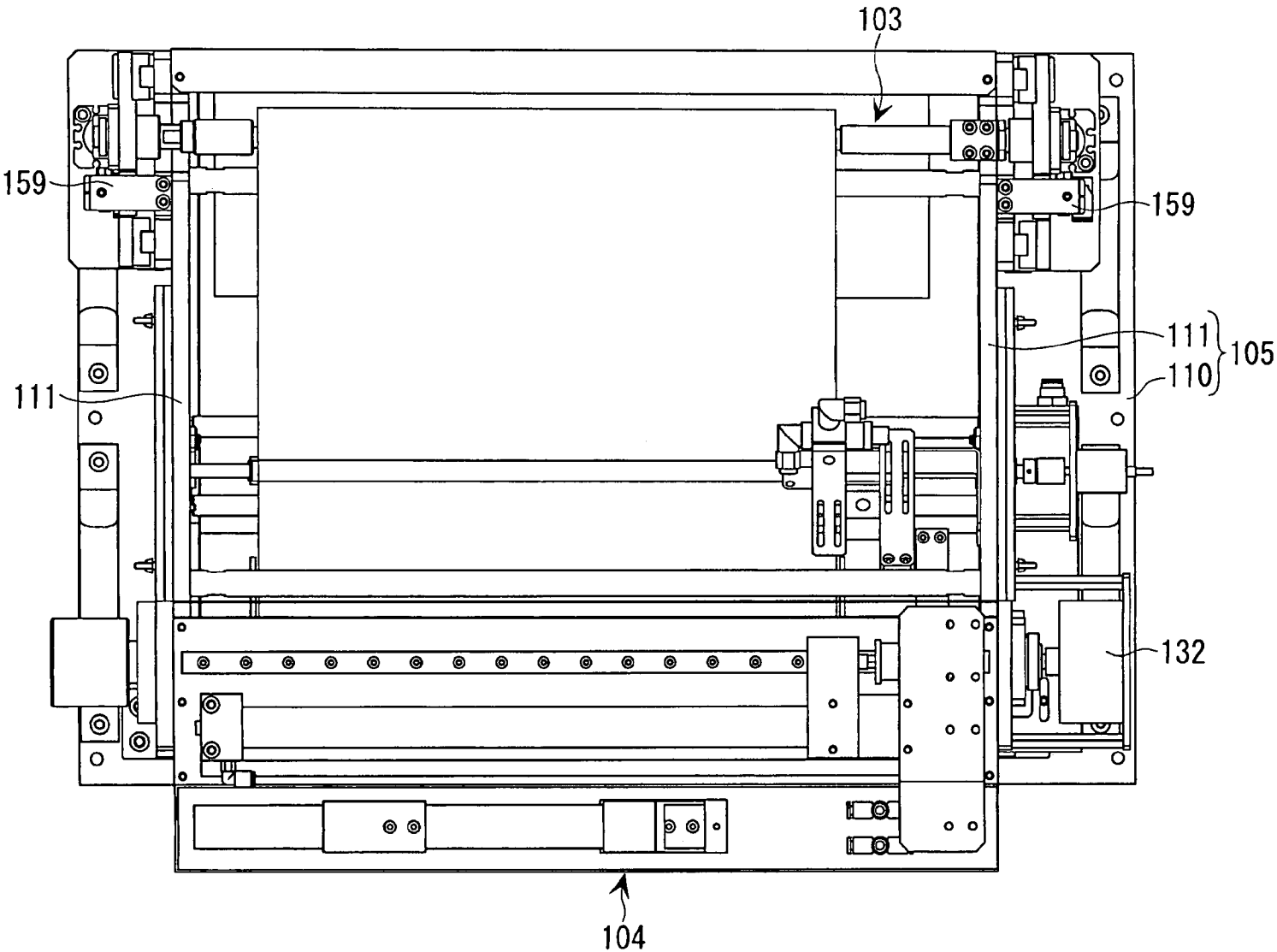
FIG. 7 is a schematic of the wiping unit of the exemplary embodiment.
Figure 9:
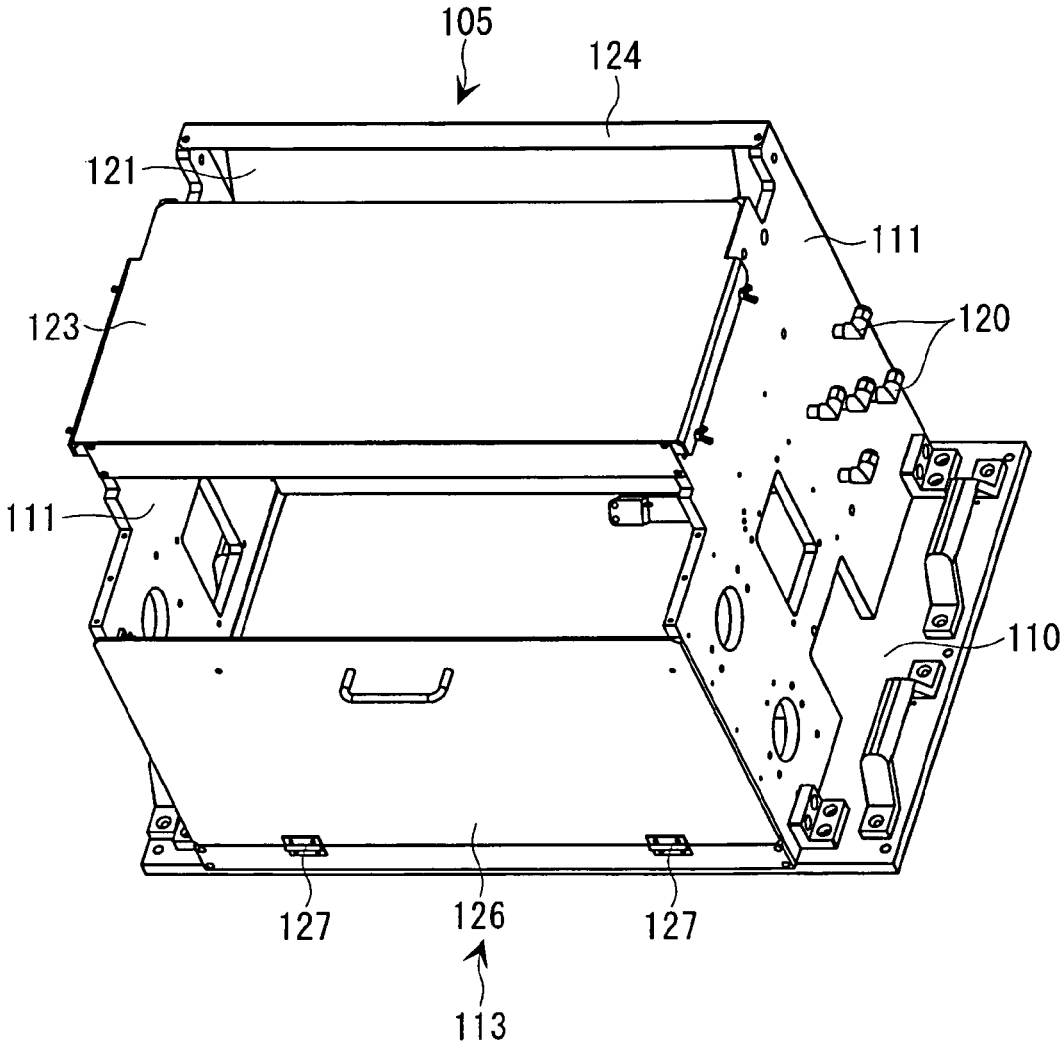
FIG. 9 is a schematic of a frame unit of the exemplary embodiment.

The wiping unit 100 shown in FIGS. 5 and 9 wipes the nozzle surface 33 of the droplet discharge head 21 that has been soiled by the suction of the functional fluid of the droplet discharge head 21. This is done by extracting a wiping sheet 101 with a stain of the functional fluid being firmly attached to the nozzle surface 33. This way the stain stuck to the nozzle surface 33 is eliminated. Note that the front, back, right and left directions in FIG. 5 are referred to as the forward, back, right and left directions of the wiping unit 100, respectively, for convenience of explanation.

The wiping unit 100 includes a sheet feeder mechanism 102, a wiper part 103, a cleaner spray unit 104, an electrostatic applying unit 200, and a unit flame 105. The sheet feeder mechanism 102 extracts and rolls up the wiping sheet 101. The wiper part 103 makes the extracted wiping sheet 101 contact with the nozzle surface 33 of the droplet discharge head 21 so as to wipe it. The cleaner spray unit 104 sprays and applies a cleaner including a functional liquid solvent to the wiping sheet 101 before it wipes the nozzle surface 33. The electrostatic applying unit 200 makes the cleaner electrically charged and actively prevents it from getting dispersed and adhering to peripheral units. The unit flame 105 supports the above-mentioned major members of the wiping unit 100. Outside the wiping unit 100, a cleaner supply unit (not shown) that provides the cleaner spray unit 104 with a cleaner and an air supply unit (not shown) that provides the cleaner spray unit 104 and the wiper part 103 with compressed air are provided side by side, whose operations are controlled by a controller.

Each element of the wiping unit 100 will now be described in greater detail.

The unit frame 105 includes a base frame 110 placed on the moving table 60 of the lithography device 1, and a pair of side frames 111 standing at each end of the base frame 110. The unit frame 105 also includes a cleaner dispersion prevention cover 112 and a safety cover 113. The cleaner dispersion prevention cover 112 covers the periphery of the sheet feeder mechanism 102 so as to prevent the cleaner from getting dispersed. The safety cover 113 covers the periphery of the sheet feeder mechanism 102 and the cleaner spray unit 104.

Each side of the pair of side frames 111 has five air outlets 120, so that air containing the cleaner inside the unit frame 105 will be discharged to an exhaust processing unit (not shown) outside the wiping unit 100 via an exhaust tube coupled to the air outlets 120 by spraying the cleaner.

The cleaner dispersion prevention cover 112 is a plate frame fixed to bridge over the left and right side frames 111 in order to reduce or prevent the cleaner sprayed by a cleaner spray head 161 being dispersed from the opening between the both side frames 111 and attaching to peripheral units outside the wiping unit 100. The cleaner dispersion prevention cover 112 includes an upper cover 123, a back cover 124, an inside cover 121, and a bottom cover 122. The upper cover 123 covers the upper opening between the side frames 111. The back cover 124 covers the back opening between the side frames 111. The inside cover 121 is inclined to and extends inside the wiping unit so as to cover the wiper part 103 and the fed wiping sheet. The bottom cover 122 is provided to cover a back area below the inside cover 121, and has a function as a cleaner pan.

While the electrostatic applying unit 200 reduces or prevents the cleaner from getting dispersed in the present exemplary embodiment, the cleaner dispersion prevention cover 112 is also provided to make sure peripheral units are protected, which will be described in greater detail later.

The safety cover 113 reduces the likelihood or prevents the cleaner spray unit 104 and the sheet feeder mechanism 102 performing mechanical operations that the wiping process involves from rolling up something other than specified members. The safety cover 113 includes a box-like unit safety cover 125 and a mechanism safety cover 126. The unit safety cover 125 is placed on the upper front part of the side frames 111 so as to thoroughly cover the cleaner spray unit 104. The mechanism safety cover 126 is placed on the front side surface of the side frames 111 so as to cover the sheet feeder mechanism. The mechanism safety cover 126 is a plate frame that is roughly square, and is rotatably supported by a pair of hinges 127, provided below, at the front side surface of the unit frame 105. With the mechanism safety cover 126, the front opening of the side frames 111 can be opened and closed. The mechanism safety cover 126 remains closed with a pair of magnet catchers 128 provided on the upper front side of the side frames 111. As mentioned above, the unit frame 105 including the cleaner dispersion prevention cover 112 and the safety cover 113 forms the box-like frame to prevent the cleaner sprayed inside the unit frame 105 from getting dispersed and adhering to peripheral units.

The sheet feeder mechanism 102 extracts the wiping sheet 101 that wipes the nozzle surface 33 of the droplet discharge head 21 to the wiper part 103, and also rolls up the wiping sheet 101 after the wiping.

Figure 8:
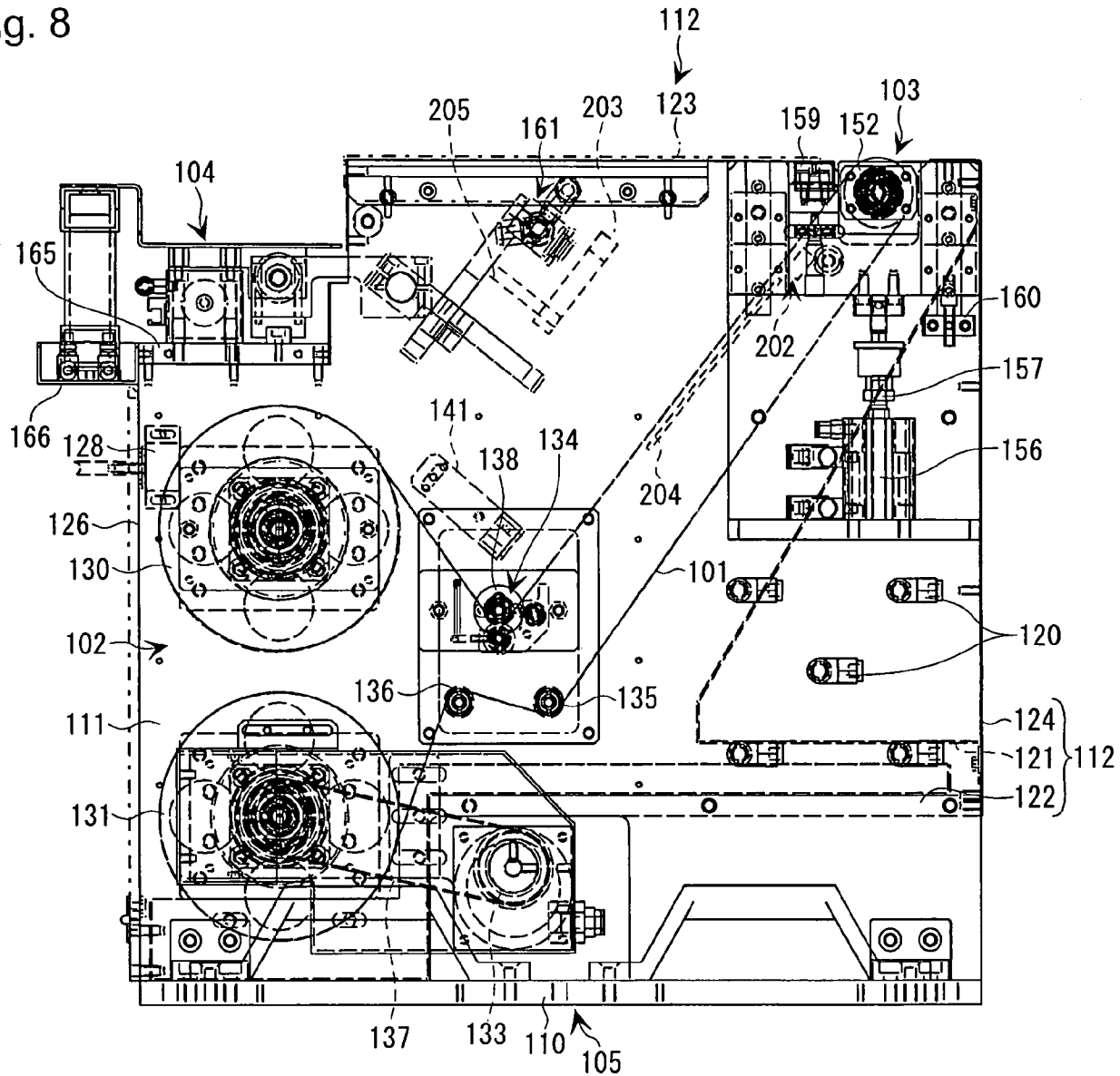
FIG. 8 is a schematic illustrating the inner structure of the wiping unit of the exemplary embodiment.

Referring to FIG. 8, the sheet feeder mechanism 102 is provided from the front part to the upper back side of the inside of the unit frame 105. The sheet feeder mechanism 102 includes on the front part an extraction reel 130 and a roll-up reel 131 whose axes are rotatably and removably supported by the pair of side frames 111 standing at each end. The extraction reel 130 supplies the wiping sheet 101. The roll-up reel 131 is provided below the extraction reel 130 to roll up and remove the wiping sheet. Provided at the end of the axis of the extraction reel 130 is a torque limiter 132 that brakes the rotation of the reel and rotates at a fixed torque. The roll-up reel 131 is coupled to a roll-up motor 133 that rotates it through a timing belt 133.

Provided from the front part to the upper back side of the unit frame 105 are a velocity detection roller 134, a first guide roller 135 and a second guide roller 136. The velocity detection roller 134 detects the feed velocity of the wiping sheet 101. The first guide roller 135 and the second guide roller 136 prevent the wiping sheet 101 from interfering with the velocity detection roller 134 and the bottom cover 122 and guide the wiping sheet 101. In addition, a sheet feed channel of the wiping sheet 101 is provided to make the wiping sheet 101 go around these plural axes.

The wiping sheet 101, supplied by the extraction reel 130, is fed to the wiper part 103 via the velocity detection roller 134. After going around the wiper part 103 and wiping the nozzle surface of the droplet discharge head 21, the wiping sheet 101 is rolled up by the roll-up reel 131 via the first guide roller 135 and the second guide roller 136 provided below the velocity detection roller 134.

The timing belt 137 bridges over the roll-up reel 131 and the roll-up motor 133. The roll-up reel 131 rotates when the roll-up motor 133 is driven, and thereby rolling up the wiping sheet 101. The velocity of the roll-up motor 133 is controlled based on detection results of a velocity detector 138 provided at the end of the axis of the velocity detection roller 134, which will be described later.

A roll of the wiping sheet 101 is inserted in the extraction reel 130. When the roll-up reel 131 rolls up the wiping sheet 101, the wiping sheet 101 is newly extracted from the extraction reel 130. Accordingly, the wiping sheet 101 is extracted. Also, the torque limiter 132 provided with the extraction reel 130 rotates to brake against the roll-up motor 133 rolling up the sheet, and constantly applies a fixed tension on the sheet, and thereby reducing the likelihood or preventing the wiping sheet 101 from getting loose.

The roll-up reel and the extraction reel 130 are supported by the side frames 111 at the end of their axes. A roll-up reel holder 139 and an extraction reel holder 140 are removably provided at the left end of their axes with the side frames 111 therebetween. When the wiping sheet 101 is replaced in the extraction reel 130 and the wiping sheet 101 that has been rolled up by the roll-up reel 131 is removed from the device, the roll-up reel holder 139 and the extraction reel holder 140 are removed from the end of the axes so as to remove the reels 139 and 140 from the wiping unit 100.

The velocity detection roller 134 is a grip roller including two rollers (upper and lower rollers) that freely rotate. With the velocity detector 138 provided to one roller, the velocity detection roller 134 detects the feed velocity of the wiping sheet 101. In addition, a sheet detector 141 using an optical-reflective photo sensor is placed in the sheet feed channel between the extraction reel 130 and the velocity detection roller 134. The sheet detector 141 detects the presence of the wiping sheet 101 in a facing area and detects the end of the sheets passing through. Detection results are output to a controller 6, and used to control the operation of the wiping unit 100.

The wiper part 103 wipes the nozzle surface 33 of the droplet discharge head 21 with the wiping sheet 101 extracted by the sheet feeder mechanism 102. The wiper part 103 includes a pair of bearing frames 151, a pressure roller 152, and a pressure roller lift 150. The bearing frames 151 are slidably provided in the upper and lower directions outside the upper side of the side frames 111. The pressure roller 152 is rotatably supported by the bearing frame 151. The wiping sheet 101 goes around the pressure roller 152. The pressure roller lift 150 is fixed to the side frames 111, and lifts and lowers the pressure roller 152 through the bearing frames 151.

The pressure roller 152 is of an axial length corresponding to the width of the wiping sheet 101. The pressure roller 152 including an elastic roller whose axis part is surrounded by an elastic body, such as rubber, so as not to damage the nozzle surface 33 of the droplet discharge head 21 during the wiping.

The pressure roller lift 150 includes a pair of sub frames 155 and a pair of pressure roller lift cylinders 156. The sub frames 155 are fixed to the upper part of the outer side of the pair of side frames 111. The pressure roller lift cylinders 156 are fixed upward to each of the sub frames 155. The pressure roller lift cylinders 156 are air-driven cylinders moving back. At the end of their piston rods 157, the bearing frame 151 is coupled. Therefore, when the pair of pressure roller lift cylinders 156 are driven at the same time, the wiping sheet 101 going around the pressure roller 152 is lifted to come in contact with the nozzle surface 33 of the droplet discharge head 21.

The sub frames 155 have an L-shaped cross section. At the upper surface of their bottoms, the frame of the pressure roller lift cylinders 156 is fixed. On the inner side of the sub frames 155, a pair of guide parts 158 are provided that are engaged to the bearing frame 151 and guide the lifting and lowering of the bearing frame (see FIG. 5).

The pressure roller lift 150 includes a lifting end limit member 159 and a lowering end limit member 160 that limit the range in which the bearing frame 151 is lifted and lowered. The lifting end limit member 159 is fixed to the side frames 111 at the upper part of a position in which the bearing frame 151 is provided. As the bearing frame 151 being lifted comes in contact with the lifting end limit member 159, the lifting end limit member 159 limits the lifting end of the pressure roller 152. Here, the surface of the wiping sheet 101 going around the pressure roller 152 contacting with the droplet discharge head 21 is set to be lifted slightly higher than the nozzle surface of the droplet discharge head 21. The lowering end limit member 160 is fixed to the side frames 111 at the lower part of the pressure roller lift 150. As the bearing frame 151 being lowered comes in contact with the lowering end limit member 160, the lowering end limit member 160 limits the lowering end of the pressure roller 152.

As mentioned above, the bearing frame 151 that supports the pressure roller 152 is liftably fitted to the side frames 111. The pressure roller 152 is lifted up to the lifting end when an air supply unit (not shown) outside the wiping unit 100 provides the pressure roller lift cylinders 156 with compressed air. Accordingly, the wiping sheet 101 comes in contact with the nozzle surface 33 of the droplet discharge head 21, and together with the feeding of the wiping sheet 101, the wiping of the nozzle surface 33 of the droplet discharge head 21 is performed. After the wiping of the nozzle surface 33 is completed, air is provided to the pressure roller lift cylinder 156 for moving back. Thus the pressure roller 152 is lowered down to the lowering end, and thereby the wiping sheet 101 is separated from the nozzle surface 33 of the droplet discharge head 21.

Figure 10:
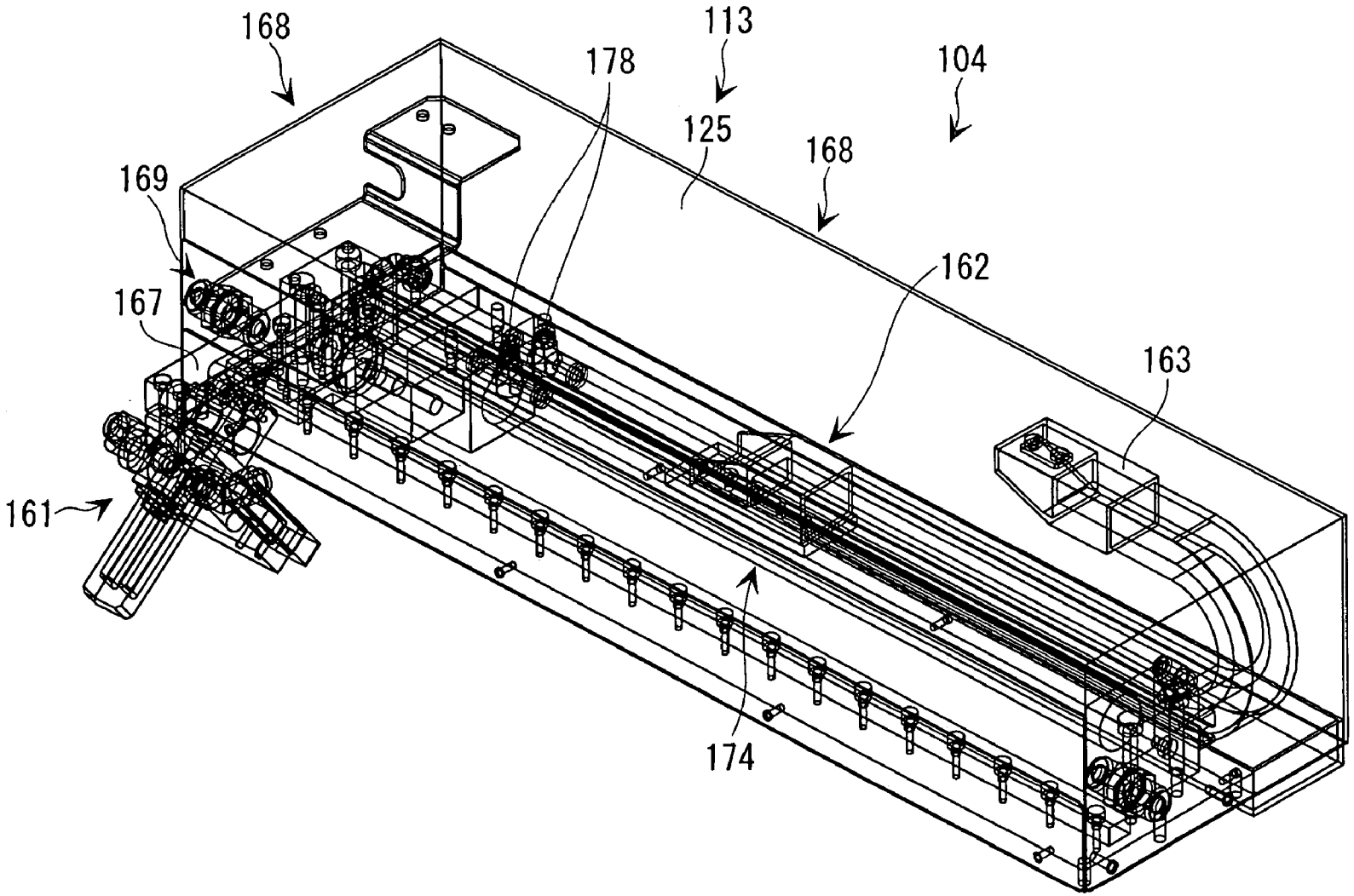
FIG. 10 is a schematic of a scanning table of the exemplary embodiment.
Figure 11:
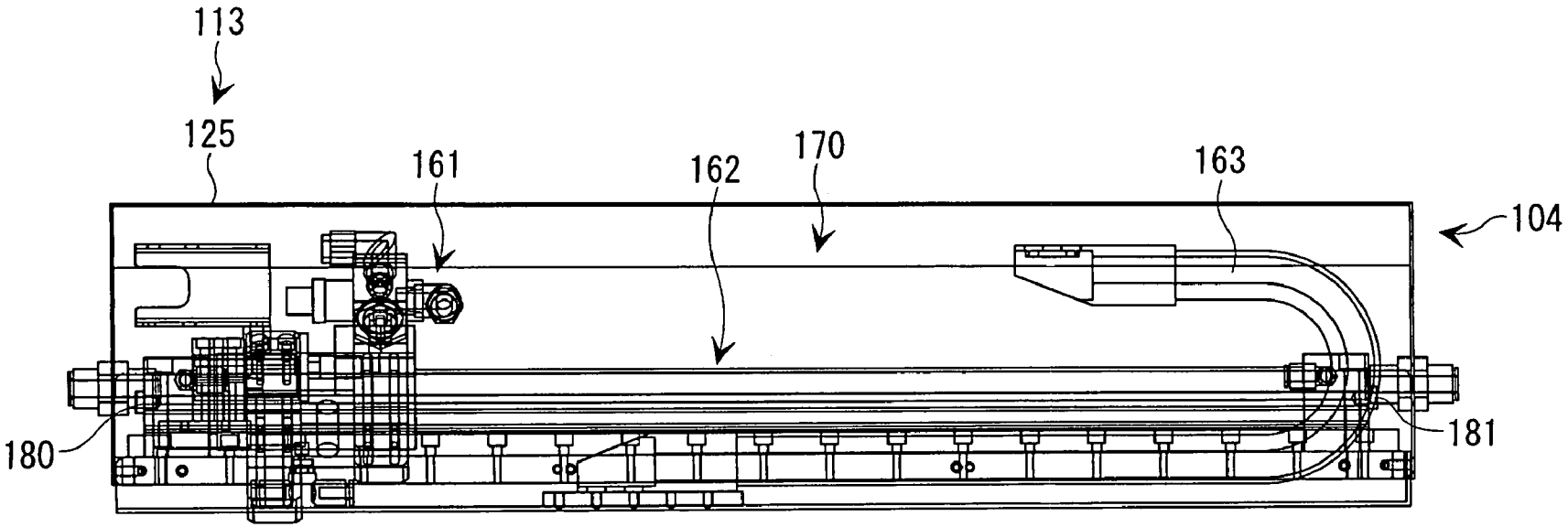
FIG. 11 is a schematic of the wiping unit of the exemplary embodiment.
Figure 12:
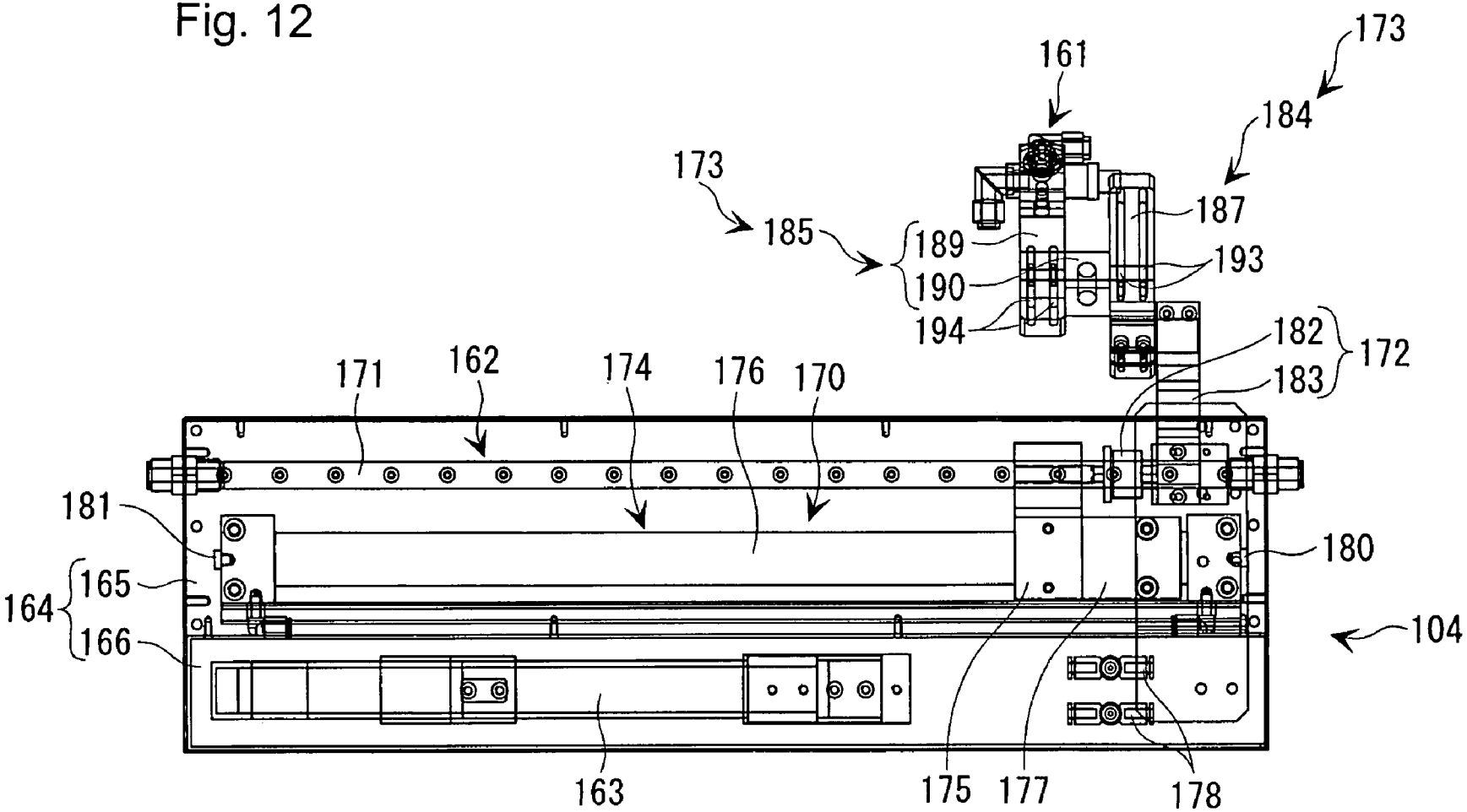
FIG. 12 is a schematic of the wiping unit of the exemplary embodiment.
Figure 13:
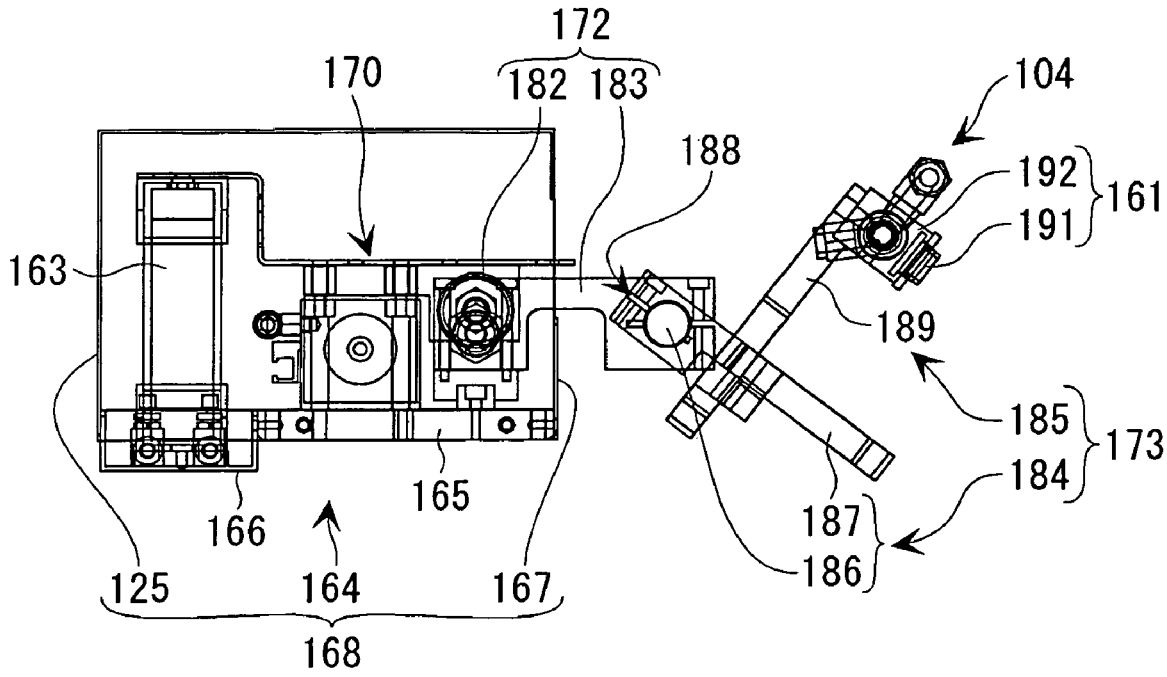
FIG. 13 is a schematic of the wiping unit of the exemplary embodiment.

As shown in FIGS. 10 and 13, the cleaner spray unit 104 includes a cleaner spray head 161, a scanning table (head scanning mechanism) 162, a CABLE BEAR (trademark) 163, and a scanning table support frame 164. The cleaner spray head 161 sprays and applies a cleaner onto the wiping sheet 101. The scanning table 162 makes the cleaner spray head 161 scan in the horizontal direction. The CABLE BEAR 163 supports a cleaner supply tube and an air supply tube coupled to the cleaner spray head 161. The scanning table support frame 164 supports the scanning table 162 and the CABLE BEAR 163. The cleaner spray unit 104 is provided to the wiping unit 100, bridging over the upper front part of the side frames 111.

The scanning table support frame 164 includes a scanning table main frame 165 and a scanning table sub frame 166. The scanning table 162 is mounted on the scanning table main frame 165, while the CABLE BEAR 163 is mounted on the scanning table sub frame 166. The scanning table main frame 165 and the scanning table sub frame 166 extend in parallel with each other. The scanning table main frame 165 is supported so as to bridge over the side frames 111. The scanning table sub frame 166 is supported so as to be provided in front of the scanning table main frame 165 and project forward from the side frames 111.

The unit safety cover 125 that covers the cleaner spray unit 104 is provided using the scanning table main frame 165 and the scanning table sub frame 166 as bottom plates. Specifically, the cleaner spray unit 104 is housed in a spray part box 168 composed of the unit safety cover 125 including the upper, front, and both side plates; the scanning table support frame 164 serving as a bottom plate; and a back plate 167. A gap between the unit safety cover 125 and the back plate 167 is a slit opening 169 to which a head carrier 172, which will be described in greater detail later, is moved.

The scanning table 162 includes an air-driven slider mechanism 170, a slide guide 171, the head carrier 172, and a head position adjustment mechanism 173. The slider mechanism 170 makes the cleaner spray head 161 move back and forth (scan) in the horizontal direction in accordance with the width of the wiping sheet 101. The slide guide 171 is provided in parallel with the slider mechanism 170 and guides the sliding (moving back and forth) of the slider mechanism 170. The head carrier 172 supports the cleaner spray head 161 at its tip end, and is supported by the slider mechanism 170 at its base end. The head position adjustment mechanism 173 is provided between the head carrier 172 and the cleaner spray head 161.

The slider mechanism 170 includes a rodless cylinder 174 fitted with a velocity controller, and a slide block 175 that moves back and forth in the horizontal direction (in the Y-axis direction) by the rodless cylinder 174. The rodless cylinder 174 includes a cylinder tube 176 extending in the horizontal direction, and a slider 177 sliding along the cylinder tube 176. On the upper surface of the slider 177, the slide block 175 that slides by being guided by the slide guide 171 is fixed.

Provided on the scanning table sub frame 166 is a pair of flow regulating valves 178 that act as velocity controllers of the rodless cylinder 174. Of the pair of flow regulating valves 178, the flow regulating valve 178 for moving forward is coupled to a right end 180 of the cylinder tube 176, and the flow regulating valve 178 for moving back is coupled to a left end 181 of the cylinder tube 176. In addition, an air tube for moving forward (not shown) and an air tube for moving back (not shown), both coupled to the pair of flow regulating valves 178, are individually coupled to the air supply unit. In this case, the pair of flow regulating valves 178 (velocity controllers) are capable of regulating the velocity of the slider 177 moving back and forth separately. The velocity of moving forward at which the cleaner spray head 161 sprays a cleaner is regulated based on the amount of the cleaner required to be applied to the wiping sheet 101.

The head carrier 172 includes a spacer 182 and a carrier arm 183. The spacer 182 contacts with the right end of the slide block 175. The carrier arm 183 is fixed to the right end of the slide block 175 with the spacer 182 therebetween. The tip end of the carrier arm 183 passes through the slit opening 168 and extends backward so as to face the wiping sheet 101 placed in the sheet feed channel between the velocity detection roller 134 and the pressure roller 152 (see FIG. 8).

The head position adjustment mechanism 173 includes a spray angle adjustment mechanism 184 and a spray position adjustment mechanism 185. The spray angle adjustment mechanism 184 adjusts the spray angle of the cleaner spray head 161 to the wiping sheet 101. The spray position adjustment mechanism 185 adjusts the space between the wiping sheet 101 and the cleaner spray head 161 and also adjusts the spray position in the direction of sheet feeding.

The spray angle adjustment mechanism 184 includes a short circular shaft 186 and an angle adjustment arm 187. The circular shaft 186 is fixed to the tip end of the carrier arm 183. The angle adjustment arm 187 is coupled to the circular shaft 186 at its base end, and supports the cleaner spray head 161 at its tip end. The base end of the angle adjustment arm 187 has a circular inner circumference surface that is complementary to the outer circumference surface of the circular shaft, and a split slit 188 provided in a row in the circular inner circumference. A clamping screw is threadably mounted in the direction perpendicular to the split slit 188. Here, the angle of the angle adjustment arm 187 to the circular shaft 186 can be changed by loosing the clamping screw. After the angle is changed, the base end of the angle adjustment arm 187 is fixed, with clamping the circular shaft 186 clamped, by tightening the clamping screw. Accordingly, the spray angle of the cleaner spray head 161 to the wiping sheet 101 is adjusted.

The spray position adjustment mechanism 185 includes a head support arm 189 and a coupling block 190. The head support arm 189 directly supports the cleaner spray head 161. The coupling block 190 couples the head support arm 189 and the angle adjustment arm 187. The angle adjustment arm 187 is provided with a pair of long holes 193 extending in its extending direction. The coupling block 190 can be fixed at any position of the angle adjustment arm 187 in its extending direction by a pair of fixing screws that are threadably mounted to the coupling block 190 via the long holes 193. Specifically, the space between the cleaner spray head 161 and the wiping sheet 101 with the coupling block therebetween can be adjusted by loosening the pair of fixing screws.

In the same manner, the head support arm 189 is provided with a pair of long holes 194 extending in its extending direction at its base end half. The coupling block can be fixed at any position of the angle adjustment arm 187 in its extending direction by a pair of fixing screws that are threadably mounted to the coupling block 190 via the long holes 194. Specifically, the space between the cleaner spray head 161 and the wiping sheet 101 with the head support arm 189 therebetween in the sheet feeding direction can be adjusted by loosening the pair of fixing screws. At the tip end of the head support arm 189, the cleaner spray head 161 is supported. In addition, a charged electrode 203 is supported by the head support arm 189 with an insulating member 205 therebetween, which will be described in greater detail later.

As mentioned above, the cleaner is sprayed and applied with a desired position and angle to the wiping sheet 101 placed in the sheet feed channel between the velocity detection roller 134 and the pressure roller 152 by the spray angle adjustment mechanism 184 and the spray position adjustment mechanism 185.

The cleaner spray head 161 includes a spray nozzle 191 to spray the cleaner, and a nozzle holder 192 to retain and fix the spray nozzle 191 to the head support arm 189. The spray nozzle 191 is fitted with an adjustment mechanism that adjusts the spray amount of the cleaner by a knob operation. The spray nozzle 191 sprays the cleaner in an elliptical (oval) area. The long radius of the spray area is in the direction of feeding of the wiping sheet 101. By scanning the area in the width direction of the sheet, the cleaner is applied evenly on the wiping sheet 101 from a near-end area in the width direction. Note than the spray nozzle 191 may spray the cleaner in a circular area.

While the cleaner spray head 161 including the spray nozzle 191 is fixed in the direction perpendicular to the wiping sheet 101 in the present exemplary embodiment, the cleaner spray head 161 may be tilted to the wiping sheet 101.

In the present exemplary embodiment, a liquid crystal material of a liquid crystal display is used as the functional liquid, ultraviolet curing and thermosetting resin as a spacer material, and polyethylenedioxythiophene (PEDOT) as a light-emitting material of an organic electroluminescent device or hole-transport-layer material.

As the cleaner, volatile solvents, such as xylene and ethanol, are used depending on types of functional liquids.

The wiping sheet 101 is made of a wiper material (cloth material) of 100% polyester or 100% polypropylene, which are comparatively hard to solve with solvents used as the cleaner.

Figure 14A:
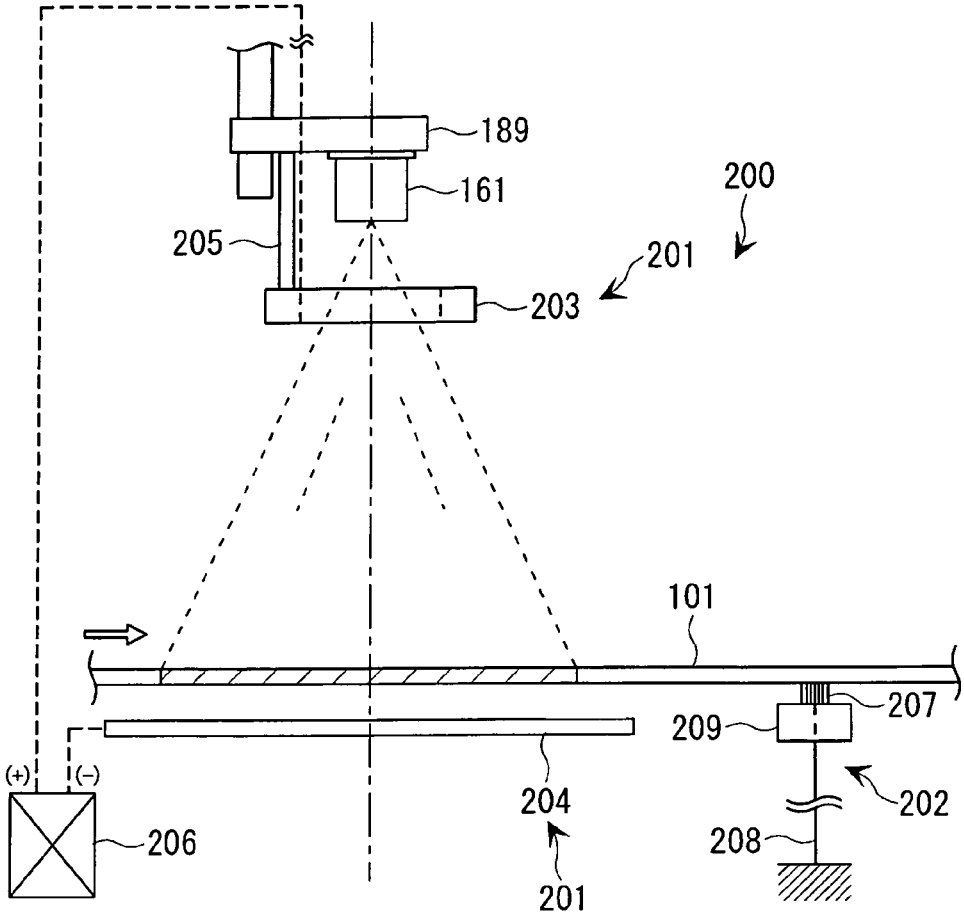
FIGS. 14A and 14B are schematics illustrating the structure of an electrostatic applying unit of the exemplary embodiment.

Referring to FIGS. 14A and B, the electrostatic applying unit 200 includes a charged part 201 and a sheet static elimination part 202. The charged part 201 absorbs the spray of the cleaner on the wiping sheet. The sheet static elimination part 202 eliminates static charges from the wiping sheet 101.

The charged part 201 includes the charged electrode 203, an absorption electrode 204, and a power unit 206 (see FIGS. 8 and 14A and B). The charged electrode 203 is provided on the front surface of the sheet, while the absorption electrode 204 is provided on the back surface of the wiping sheet 101, opposite to the charged electrode 203. The power unit 206 supplies voltage to the electrodes.

The charged electrode 203 is a roughly ring-shaped electrode. The charged electrode 203 is supported by the head support arm 189 of the scanning table 162 with the insulating member 205 therebetween, so as to follow the horizontal scanning (in the Y-axis direction) of the cleaner spray head 161. The charged electrode 203 is also placed face to face with the front surface side of the wiping sheet 101 with the direction of the ring central axis of the charged electrode 203 aligned to the spraying direction of the cleaner spray head 161. Furthermore, the charged electrode 203 is provided with electric charges by the power unit 206 to be constantly charged while spraying the cleaner. Therefore, the cleaner for spray scanning sprayed by the cleaner spray head 161 is constantly charged after passing through the ring-shaped charged electrode 203 provided in the spraying direction.

While the shape of the charged electrode 203 is roughly a ring in the present exemplary embodiment, this is not intended to limit the shape of the charged electrode 203 according to an exemplary aspect of the present invention. Any shape will do, such as an integral unit of the charged electrode 203 and the spray nozzle 191, as long as it makes the cleaner get charged.

The absorption electrode 204 is a sheet-like electrode provided on the back surface side of the sheet, slightly inside of the both ends in the width direction of the wiping sheet 101. The absorption electrode 204 is provided slightly apart from the wiping sheet 101 in parallel with the sheet. The power unit 206 applies reverse voltage, which is opposite to the voltage applied to the charged electrode 203, to the absorption electrode 204. The structure of the absorption electrode 204, which is provided inside of the both ends in the width direction of the wiping sheet 101, reduces the likelihood or prevents the sprayed cleaner from getting behind the wiping sheet 101 and adhering to the absorption electrode 204 or the back surface of the wiping sheet 101.

While the absorption electrode 204 is a square, sheet-like electrode in the present exemplary embodiment, this is not intended to limit the shape of the absorption electrode 204 and any shape will do depending on the shape of an area required to be applied. The absorption electrode 204 may contact with the back surface of the wiping sheet 101, as long as the absorption electrode 204 is placed on the back surface side of the wiping sheet 101.

The power unit 206 is a direct-current voltage stabilized power unit that is provided outside the wiping unit 100. Through a conductive cable, the positive output terminal of the power unit 206 is coupled to the charged electrode 203, while the negative output terminal of the power unit 206 is coupled to the absorption electrode 204. While a voltage of 400 volts is supplied to the both electrodes 203 and 204 of the present exemplary embodiment, the supplied voltage may be adjusted in accordance with the required suction of the cleaner.

The sheet static elimination part 202 is provided on the course of the sheet that is downstream of the charged electrode 203 of the wiping unit 101 and upstream of the droplet discharge head 21 so as to contact with the back surface of the wiping sheet 101. The sheet static elimination part 202 includes a conductive static elimination brush 207 to eliminate static charges, a conductive cable 208 to ground the static elimination brush 207, and a sheet static elimination block 209 provided to the unit frame 105 and supporting the brush and cable. Eliminating static charges from the wiping sheet 101 can reduce the likelihood or prevent a circuit included in the droplet discharge head 21 from being damaged by static charges, etc., when the wiping sheet 101 wipes the droplet discharge head 21. While the sheet static elimination part 202 of the present exemplary embodiment uses the static elimination brush 207, it may use an ionizer or the like instead.

The operation of the wiping unit 100 according to the present exemplary embodiment that sprays the cleaner and wipes the nozzle surface 33 of the droplet discharge head 21 will now be described.

After the absorption unit 70 of the droplet discharge head 21 finishes absorbing the cleaner, the moving table 60 (X-axis moving table) is operated to move the wiping unit 100 forth to a position directly below the droplet discharge head 21 of the head unit 20 placed in the maintenance area 80, passing through a position corresponding to the head unit 20 and moving the pressure roller 152 to rearward of the position.

Subsequently, while the feeding of the wiping sheet 101 is suspended, the cleaner spray unit 104 is operated to start spraying the cleaner. Specifically, while the cleaner spray head 161 sprays the cleaner, the scanning table 162 is moved back and forth at a fixed rate to scan in the width direction of the wiping sheet 101 (in the Y-axis direction). The cleaner spray head 161 stops spraying the cleaner at the same time as it finishes moving forward.

After the cleaner is applied, the pressure roller lift cylinders 156 are operated to lift the pressure roller 152 to a predetermined lifting end. At the same time, the roll-up motor 133 is driven to start feeding the wiping sheet 101. In sync with this, the moving table 60 is driven to move the entire wiping unit 100 forward (in the X-axis direction). Specifically, while the wiping sheet 101 is fed to the feeding direction (rearward of the droplet discharge head 21), the wiping unit 100 is moved forward, and thereby the velocity of the wiping sheet 101 to the nozzle surface 33 of the droplet discharge head 21 increases.

Subsequently, at the timing that the applied area of the wiping sheet 101 reaches the position of the pressure roller 152, the nozzle surface 33 of the head unit 20 comes in contact with the wiping sheet 101. Thus the nozzle surface 33 is sequentially wiped from the one on the rearmost of the head unit 20 (twelve droplet discharge heads, each corresponding to the droplet discharge head 21) to the one on the front. Specifically, since a plurality of nozzle surfaces (each corresponding to the nozzle surface 33) of the head unit 20 sequentially come in contact with the wiping sheet 101 that is extracted, all the nozzle surfaces of the droplet discharge head 21 are wiped by the applied area of the wiping sheet 101. The feeding of the wiping sheet 101 may be suspended while the pressure roller 152 moves from one nozzle surface 33 to the neighboring nozzle surface 33, and the feeding of the wiping sheet 101 is resumed slightly before the corresponding nozzle row 34 reaches the position of the pressure roller 152. Thus it is possible to efficiently use the wiping sheet 101.

Here, the velocities of feeding the wiping sheet 101 and moving the droplet discharge head 21 are desirably set depending on the types of the functional liquid and cleaner. When a required wiping area is longer in the direction of sheet feeding than the spray area of the spray nozzle 191, the cleaner may be sprayed and applied to the wiping sheet 101 by repeatedly moving the cleaner spray head 161 back and forth for spraying.

After the wiping of the nozzle surface 33 of the droplet discharge head 21 is completed, the driving for the moving table 60 and the roll-up motor 133 is stopped, and thereby stopping the feeding of the wiping sheet 101 facing with the droplet discharge head 21. Then, the pressure roller lift cylinder 156 for moving back is provided with compressed air, and thereby lowering the wiper part 103 and separating the wiping sheet 101 from the nozzle surface 33 of the droplet discharge head 21.

The operation of the wiping unit 100 according to the present exemplary embodiment that sprays and applies the cleaner and its effect to prevent the cleaner from getting dispersed will now be described.

Figure 14B:
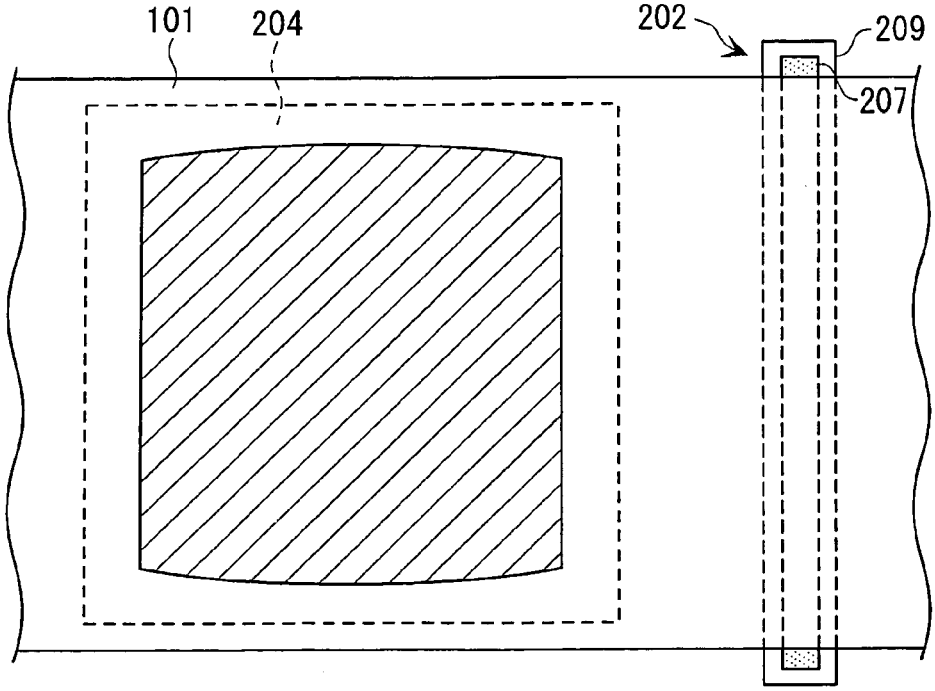

FIG. 14A is a schematic showing the electrostatic applying unit of the present exemplary embodiment. FIG. 14B is a schematic showing the electrostatic applying unit seen from the cleaner spray head.

The cleaner sprayed by the cleaner spray head 161 is positively charged by passing through the inside of the ring-shaped charged electrode 203. While the charged cleaner is absorbed toward the absorption electrode 204 that is negatively charged, the cleaner hits and adheres to the wiping sheet 101 placed just before the absorption electrode 204. Here, part of the cleaner hitting the wiping sheet 101 is reflected by the wiping sheet 101 and gets dispersed without being applied on the wiping sheet 101.

Even if the cleaner gets dispersed, it is continuously absorbed toward the absorption electrode 204, since the cleaner itself is charged. Therefore, the cleaner adheres to an area of the wiping sheet 101 that faces the absorption electrode 204. Accordingly, the cleaner is prevented from adhering to peripheral units.

Subsequently, the cleaner adhering to the wiping sheet 101 remains charged and reaches the sheet static elimination part 202, and is neutralized by the static elimination brush 207 coming in contact with the back surface of the sheet. Furthermore, the wiping sheet 101 is fed so as to wipe the nozzle surface 33 of the droplet discharge head 21.

The wiping unit 100 according to the present exemplary embodiment can efficiently reduce or prevent the cleaner from getting dispersed and adhering to peripheral units, and also reduce unnecessary consumption of the cleaner since the sprayed cleaner surely adheres to the wiping sheet 101.

Figure 15:
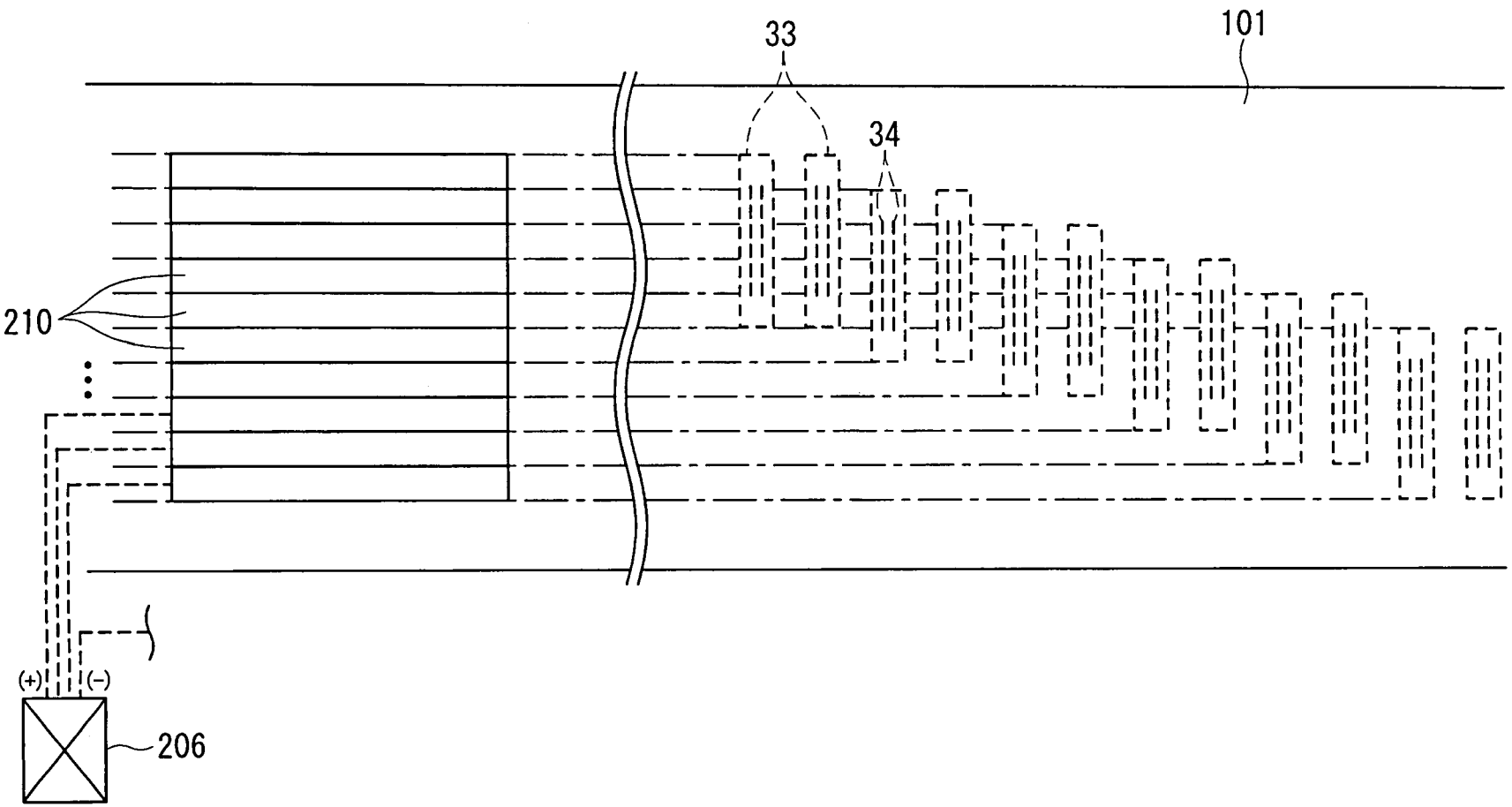
FIG. 15 is a schematic illustrating a second exemplary embodiment.

As shown in FIG. 15, the absorption electrode 204 may include a plurality of split absorption electrodes 210. Among the split absorption electrodes 210, electrodes to be charged can be desirably selected. In this case, the charged part 201 of the electrostatic applying unit 200 includes the charged electrode 203, the plurality of split absorption electrodes 210 provided to the back surface of the wiping sheet 101, and the power unit 206 that selectively applies voltage to each of the split absorption electrodes 210. Each of the split absorption electrodes 210 is a rectangular, strip-shaped electrode. Its longer side is in the feeding direction of the wiping sheet 101. The plurality of split absorption electrodes 210 are provided side by side in the width direction of the sheet, corresponding to the position of the droplet discharge head 21. The power unit 206 provides each split absorption electrode 210 individually with voltage. The voltage to be supplied can be individually selected for each split absorption electrode 210 by the control of a controller. Accordingly, a plurality of head units (each corresponding to the head unit 20) with the different arrangement of the droplet discharge head 21 are replaceable. If the cleaner is required to be applied in an area corresponding to the position of the nozzle of each head unit 20, it can be easily achieved by selecting any of the plurality of the split absorption electrodes 210 that have been arranged in advance.

In order to selectively wipe the droplet discharge head 21 with a stain, any of the plurality of the split absorption electrodes 210 is selected so as to have an applied area corresponding only to the droplet discharge head 21 required to be wiped. The pressure roller 152 is lifted up to the lifting end just before the nozzle surface 33 of the droplet discharge head 21 including the spray nozzle 191 required to be wiped reaches the position of the pressure roller 152, and the pressure roller 152 is lowered down to the lowering end after the wiping of the nozzle surface 33 required to be wiped is completed. This way it is possible to prevent the cleaner from getting dispersed by applying electric charges to the cleaner, and also reduce the spray amount of the cleaner and thus further reduce the amount of the cleaner getting dispersed, since the cleaner is sprayed only to a required split absorption electrode among the plurality of split absorption electrodes 210.

The structure and a method for manufacturing an electro-optical device (flat panel display) manufactured by using the droplet discharge unit 3 of the present exemplary embodiment will now be described, by taking a color filter, a liquid crystal display, an organic EL device, a plasma display (PDP device), an electron-emitting device (an FED device and an SED device), and an active matrix substrate provided with these displays as examples. The active matrix substrate is referred to as a substrate on which a thin-film transistor, and a source line and a data line electrically coupled to the thin-film transistor are formed.

Figure 16:
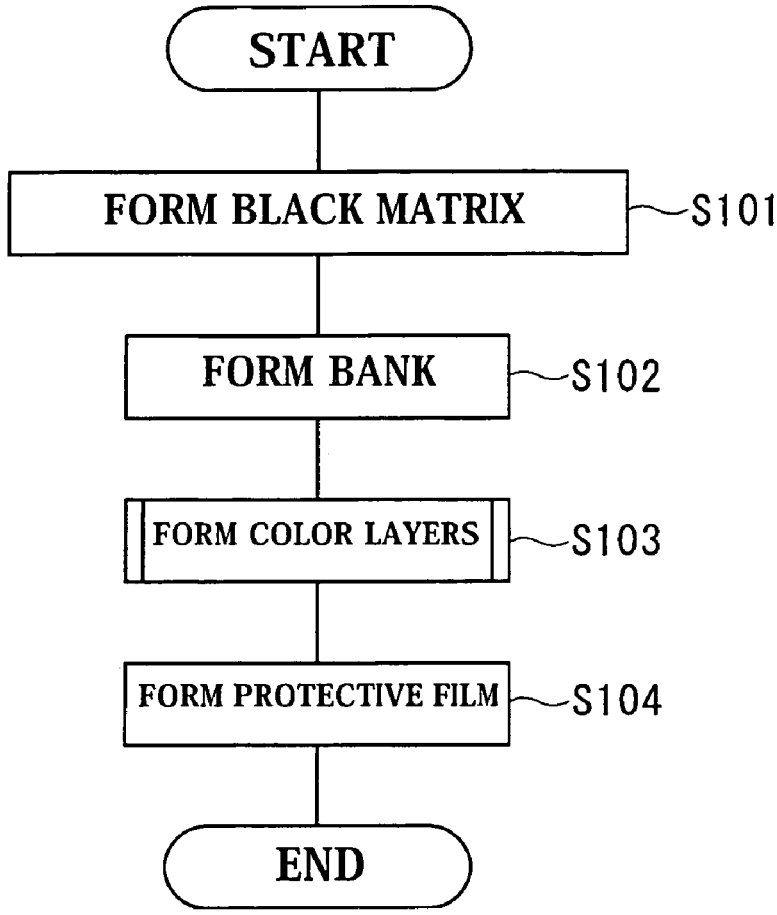
FIG. 16 is a flowchart illustrating a process for manufacturing a color filter.

A method for manufacturing a color filter incorporated into a liquid crystal display, an organic EL device or the like will now be described. FIG. 16 is a flowchart showing steps for manufacturing the color filter. FIGS. 17A–E are schematics of a color filter 500 (a filter base body 500A) of the present exemplary embodiment shown in the order of the manufacturing steps.

Figure 17A:
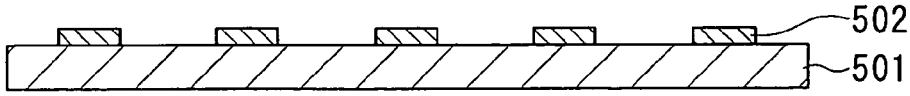
FIGS. 17A to 17E are schematics of the color filter shown in order of the manufacturing process.

Referring to FIG. 17A, a black matrix 502 is formed on a substrate (W) 501 in a step to form a black matrix (S101). The black matrix 502 is made of chromium metal, a multi-layered body of chromium metal and chromium oxide, resin black or the like. Sputtering, vapor deposition or other methods can be used to make the black matrix 502 of a thin metal film. Alternatively, gravure printing, photoresist, thermal transfer or other methods can be used to make the black matrix 502 of a thin resin film.

Figure 17B:
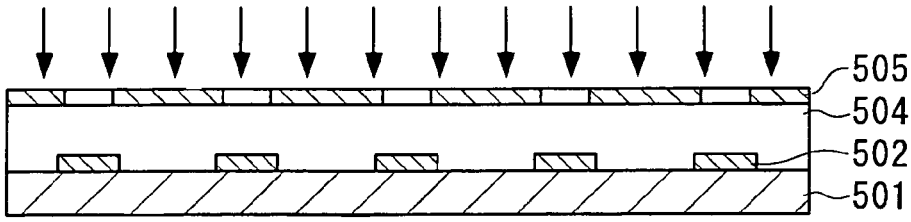

Subsequently, a bank 503 is formed, overlapping on the black matrix 502, in a step to form a bank (S102). Specifically, a resist layer 504 made of a negative transparent photosensitive resin is formed to cover the substrate 501 and the black matrix 502 as shown in FIG. 17B. Then, exposure treatment is performed with the upper surface of the resist layer 504 coated by a mask film 505 formed in a matrix pattern.

Figure 17C:
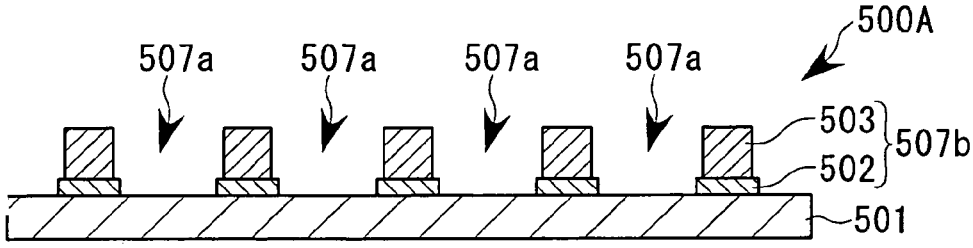

Subsequently, the unexposed part of the resist layer 504 is etched so as to pattern the resist layer 504, which forms the bank 503 as shown in FIG. 17C. If the black matrix is made of resin black, the black matrix may also serve as the bank.

The bank 503 and the black matrix 502 under the bank 503 serve as a partition wall 507*b* partitioning each pixel area 507*a*, and define an area in which a functional-liquid droplet is landed in a later step to form color layers (film-forming parts) 508R, 508G, 508B by the droplet discharge head 21.

The filter base body 500A is thus completed by the steps to form a black matrix and to form a bank.

According to the present exemplary embodiment, a resin material with a lyophobic (hydrophobic) applied surface is used as the material of the bank 503. Since the surface of the substrate (glass substrate) 501 is lyophilic (hydrophilic), the precision of the position of the droplet landing in each pixel area 507*a* surrounded by the bank 503 (partition wall 507*b*) increases in a later step to form color layers, which will be described later.

Figure 17D:
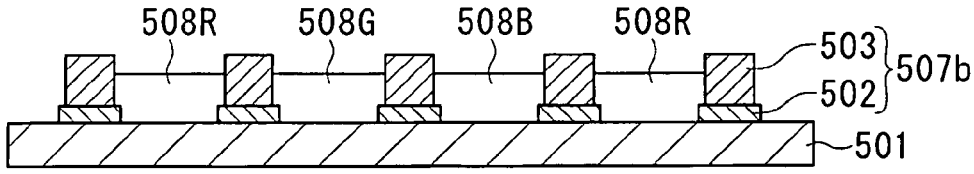

Referring now to FIG. 17D, a functional-liquid droplet is discharged by the droplet discharge head 21 and landed in each pixel area 507*a* surrounded by the partition wall 507*b* in a step to form color layers (S103). In this case, the functional liquid (filter material) of three colors, R, G, B, are injected and its droplet is discharged with the droplet discharge head 21. The three colors, R, G, B, can be arranged in stripe, mosaic, delta, and other patterns.

Figure 17E:
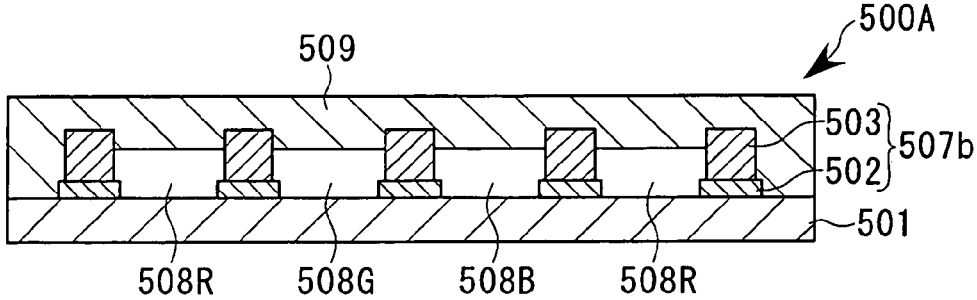

By drying treatment, such as heating, to fix the functional liquid, the three color layers 508R, 508G, 508B are completed. Forming of the color layers 508R, 508G, 508B is followed by a step to form a protective film (S104). Referring to FIG. 17E, a protective film 509 is formed to cover the substrate 501, the partition wall 507*b*, and the upper surface of the color layers 508R, 508G, 508B.

Specifically, an application liquid to form the protective film is discharged on the entire surface of the substrate 501 on which the color layers 508R, 508G, 508B are formed. Then, the protective film 509 is completed by drying treatment.

Forming of the protective film 509 is followed by forming a film of indium tin oxide (ITO) or the like to be made into a transparent electrode included in the color filter 500.

FIG. schematic showing the main structure of a passive-matrix liquid crystal device (liquid crystal device) as an example of a liquid crystal display fitted with the color filter 500. By fitting a liquid crystal device 520 with accessory elements, such as a liquid-crystal driving IC, a backlight and a support body, a transmissive liquid crystal display is completed as an end product. As for the color filter 500, which is the same as the one shown in FIG. 17A–E, like numerals indicate like parts in the drawings and their description is omitted here.

The liquid crystal device 520 is substantially composed of the color filter 500, an opposing substrate 521 made of a glass substrate or the like, and a liquid crystal layer 522 made of a super twisted nematic (STN) liquid crystal composition held between the filter and the substrate. The color filter 500 is placed on the upper side of the drawing (on the observer side).

Here, one each polarizing plate (not shown) is provided outside the opposing substrate 521 and the color filter 500 (on the side opposite to the liquid crystal layer 522). A backlight is provided outside the polarizing plate provided on the opposing substrate 521 side.

Figure 18:
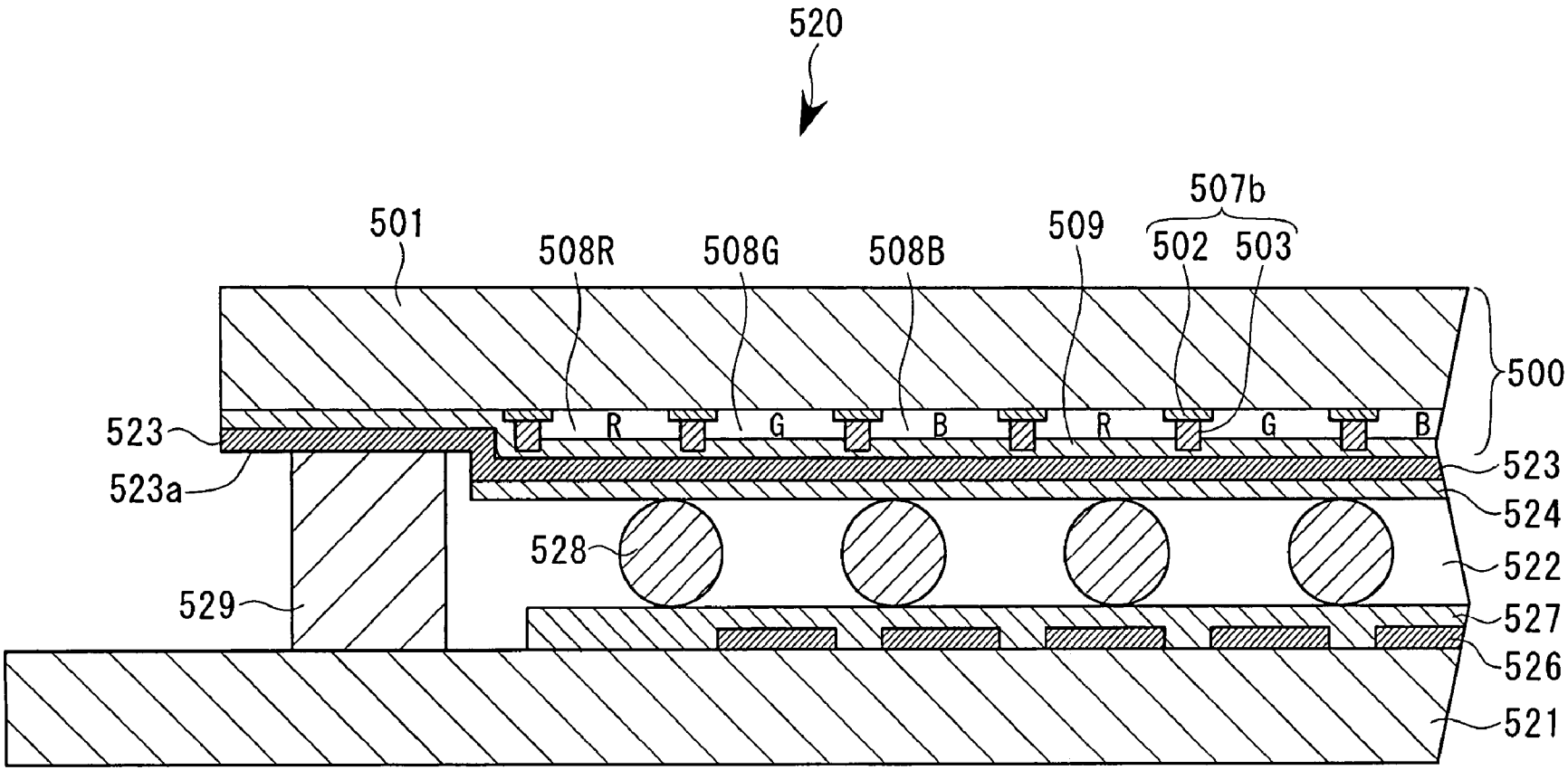
FIG. 18 is a schematic showing the main structure of a liquid crystal device fitted with a color filter to which an exemplary aspect of the present invention is applied.

On the protective film 509 (on the liquid crystal layer side) of the color filter 500, a plurality of long, strip-shaped first electrodes 523 in the horizontal direction of FIG. 18 are provided at predetermined intervals. A first orientation film 524 is formed to cover the surface of the first electrodes 523 on the side opposite to the color filter 500.

Provided on the opposing substrate 521 on the side opposite to the color filter 500 are a plurality of long, strip-shaped second electrodes 526 that are perpendicular to the first electrodes 523, provided on the color filter 500, at predetermined intervals. A second orientation film 527 is formed to cover the surface of the second electrodes 526 on the liquid crystal layer 522 side. The first electrodes 523 and the second electrodes 526 are made of a transparent conductive material, such as ITO.

A spacer 528 provided in the liquid crystal layer 522 is a member that keeps the thickness (cell gap) of the liquid crystal layer 522 constant. A seal material 529 is a member that prevents the liquid crystal composition contained in the liquid crystal layer 522 from leaking out. An end part of the first electrodes 523 extends outside of the seal material 529 as a wiring 523*a* to be laid out.

A pixel is a part where the first electrodes 523 and the second electrodes 526 intersect. Provided in the pixel are the color layers 508R, 508G, 508B of the color filter 500.

In a normal manufacturing process, the patterning of the first electrodes 523 and the application of the first orientation film 524 form the structure on the color filter 500 side, while the patterning of the second electrodes 526 and the application of the second orientation film 527 form the structure on the opposing substrate 521 side. Subsequently, the spacer 528 and the seal material 529 are provided on the opposing substrate 521 side, to which the structure on the color filter 500 side is joined. Then, liquid crystal composing the liquid crystal layer 522 is injected from an injection opening of the seal material 529, and the injection opening is closed thereafter. Then, the both polarizing plates and the backlight are stacked.

The droplet discharge unit 3 of the present exemplary embodiment can not only apply a spacer material (functional liquid) forming the cell gap, for example, but also evenly apply liquid crystal (functional liquid) to the area surrounded by the seal material 529 before joining the structure on the color filter 500 side to the structure on the opposing substrate 521 side. Furthermore, the seal material 529 can be printed with the droplet discharge head 21. In addition, the first orientation film 524 and the second orientation film 527 can also be applied with the droplet discharge head 21.

Figure 19:
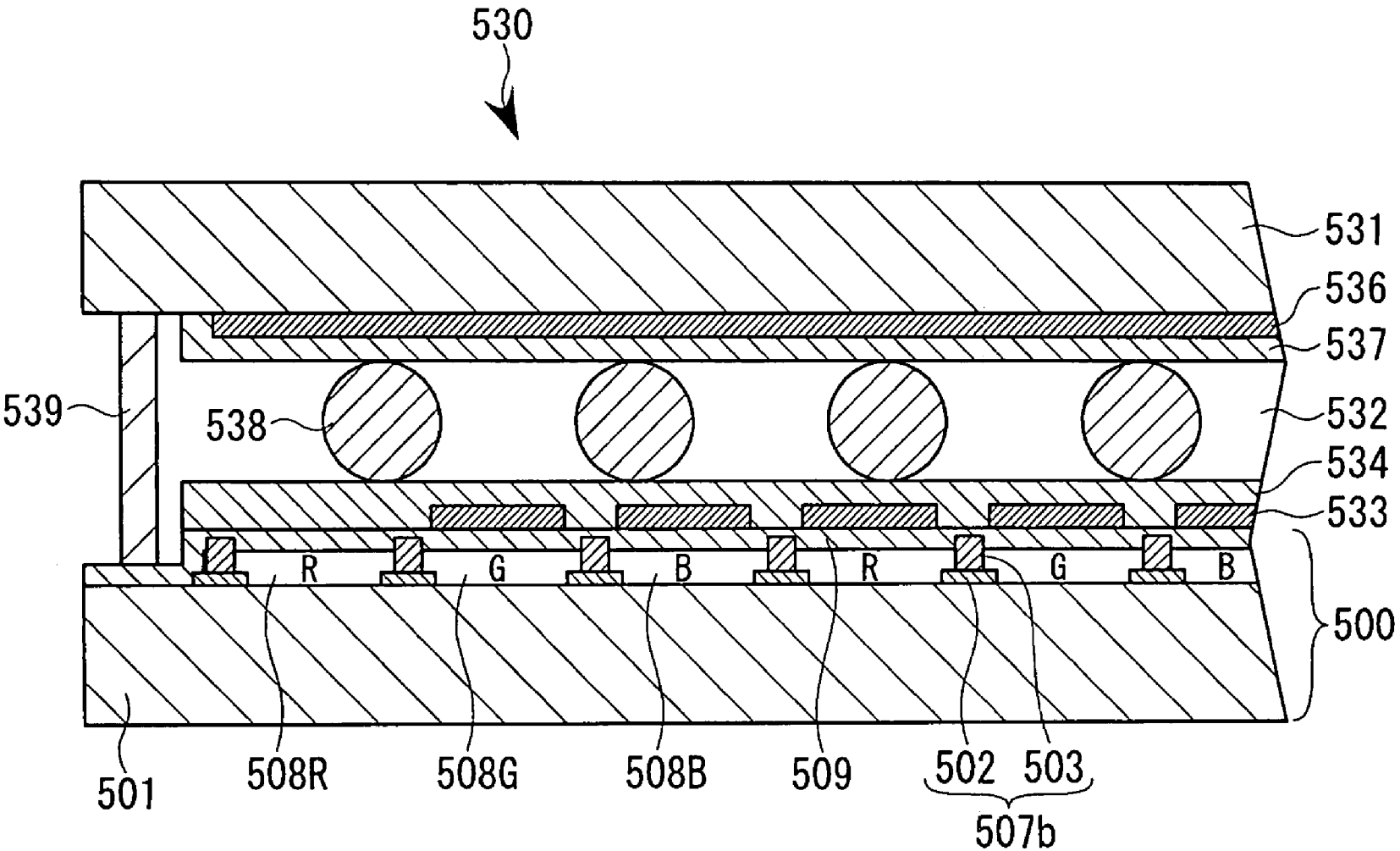
FIG. 19 is a schematic showing the main structure of a liquid crystal device of a second example fitted with a color filter to which an exemplary aspect of the present invention is applied.

FIG. 19 is a schematic showing the main structure of a second example of a liquid crystal device using the color filter 500 according to the present exemplary embodiment. What differs a liquid crystal device 530 from the liquid crystal device 520 is that the color filter 500 is placed on the lower side of the drawing (opposite to the observer side).

The liquid crystal device 530 is substantially composed of a liquid crystal layer 532 made of STN liquid crystal that is held between the color filter 500 and an opposing substrate 531 made of a glass substrate or the like. One each polarizing plate etc. (not shown) is provided outside the opposing substrate 531 and the color filter 500.

On the protective film 509 of the color filter 500 (on the liquid crystal layer 532 side), a plurality of long, strip-shaped first electrodes 533 in the depth direction of the drawing are provided at predetermined intervals. A first orientation film 534 is formed to cover the surface of the first electrodes 533 on the liquid crystal layer 532 side.

Provided on the opposing substrate 531 on the side opposite to the color filter 500 are a plurality of long, strip-shaped second electrodes 536 extending perpendicularly to the first electrodes 533, provided on the color filter 500 side, at predetermined intervals. A second orientation film 537 is formed to cover the surface of the second electrodes 536 on the liquid crystal layer 532 side.

Provided to the liquid crystal layer 532 are a spacer 538 that keeps the thickness of the liquid crystal layer 532 constant, and a seal material 539 that reduce the likelihood or prevents the liquid crystal composition contained in the liquid crystal layer 532 from leaking out.

In the same manner as in the liquid crystal device 520, a pixel is a part where the first electrodes 533 and the second electrodes 536 intersect. Provided in the pixel are the color layers 508R, 508G, 508B of the color filter 500.

Figure 20:
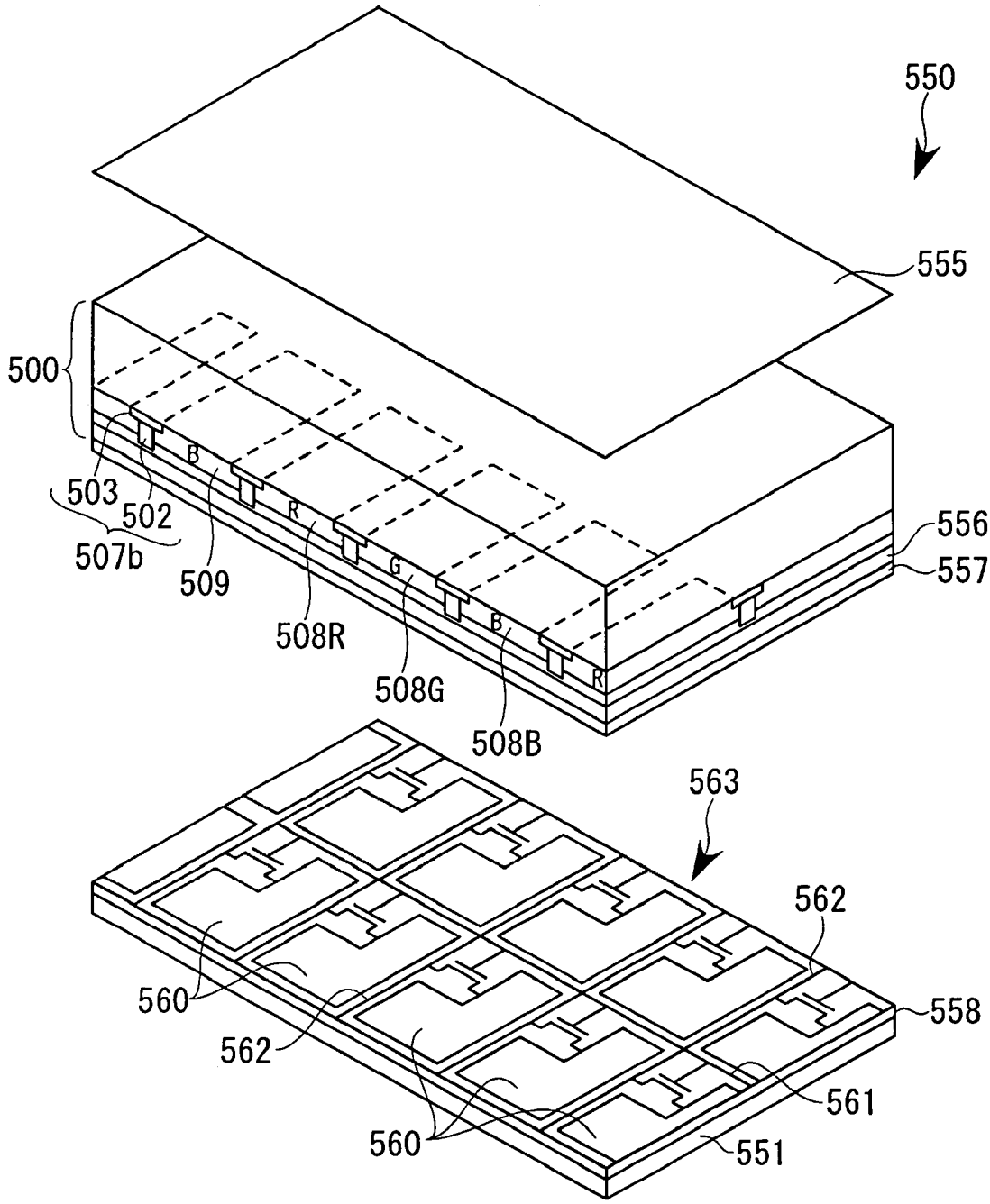
FIG. 20 is a schematic showing the main structure of a liquid crystal device of a third example fitted with a color filter to which an exemplary aspect of the present invention is applied.

FIG. 20 is a schematic showing the main structure of a transmissive thin-film transistor (TFT) liquid crystal device which is a third example of a liquid crystal device fitted with the color filter 500 according to an exemplary aspect of the present invention.

A liquid crystal device 550 includes the color filter 500 provided on the upper side of the drawing (the observer side).

The liquid crystal device 550 is substantially composed of the color filter 500, an opposing substrate 551 provided face to face with the color filter, a liquid crystal layer (not shown) held between the color filter and the substrate, a polarizing plate 555 provided on the upper side (observer side) of the color filter 500, and a polarizing plate (not shown) provided on the lower side of the opposing substrate 551.

An electrode 556 to drive the liquid crystal is provided on the surface (on the opposing substrate 551 side) of the protective film 509 of the color filter 500. The electrode 556 is made of a transparent conductive material, such as ITO, and covers the whole area in which a pixel electrode 560, which will be described later, is formed. An orientation film 557 is provided with the surface of the electrode 556 on the side opposite to the pixel electrode 560 covered.

An insulating layer 558 is provided to the opposing substrate 551 on the side opposite to the color filter 500. Provided on the insulating layer 558 are a scanning line 561 and a signal line 562 that are perpendicular to each other. In the area surrounded by the scanning line 561 and the signal line 562, the pixel electrode 560 is provided. Note that an orientation film to be provided on the pixel electrode 560 in an actual liquid crystal device is not shown in the drawing.

A thin-film transistor 563 including a source electrode, drain electrode, semiconductor and gate electrode is fitted in the part surrounded by a cutout part of the pixel electrode 560, the scanning line 561, and the signal line 562. By applying signals to the scanning line 561 and the signal line 562, the thin-film transistor 563 is turned on and off, and thus a current flow in the pixel electrode 560 is controlled.

While the liquid crystal devices 520, 530, and 550 use a transmissive structure, a reflective liquid crystal device or semi-transmissive reflective liquid crystal device fitted with a reflective layer or a semi-transmissive reflective layer can also be used instead.

Figure 21:
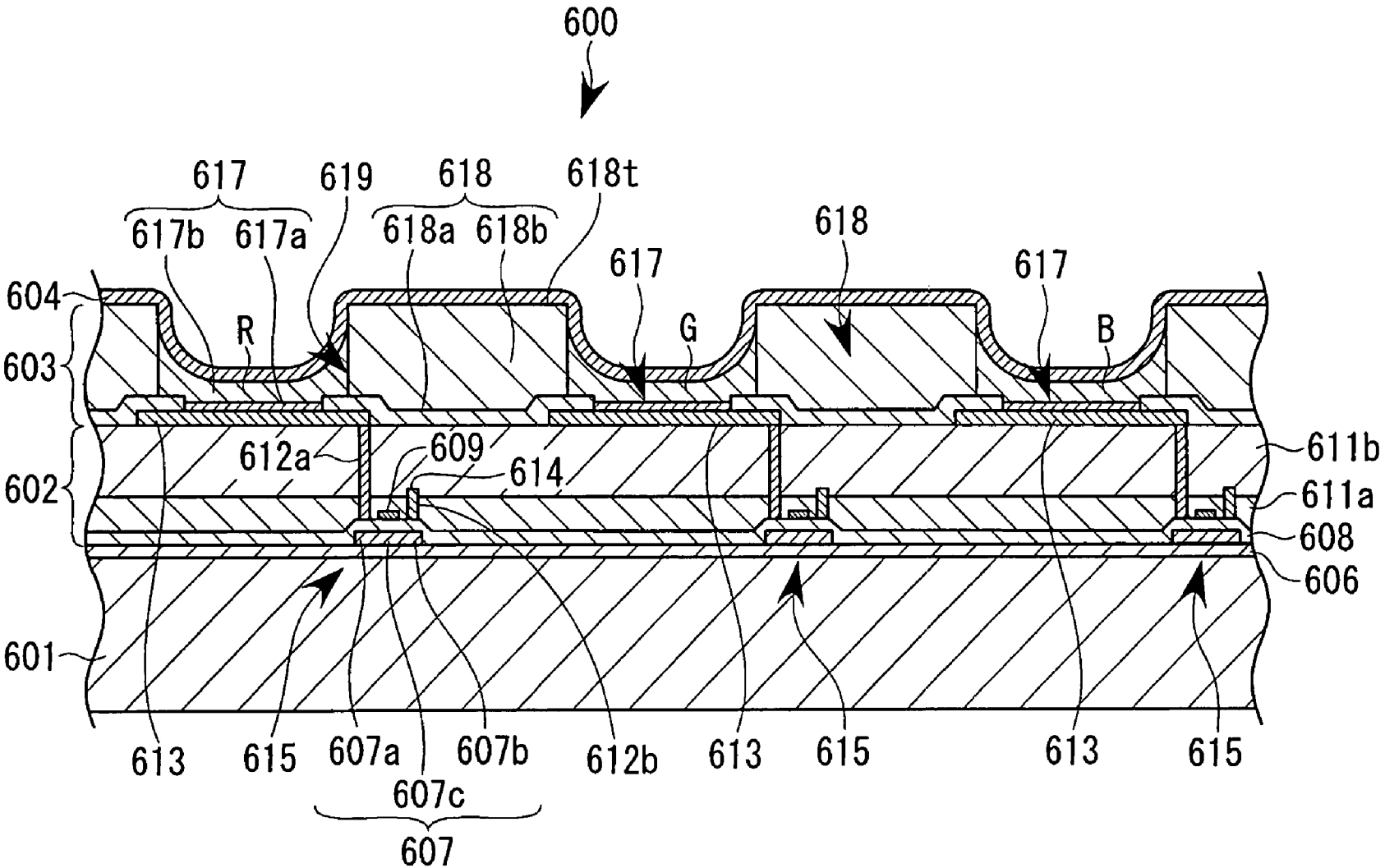
FIG. 21 is a schematic showing the main structure of a display that is an organic EL device.

FIG. 21 is a schematic showing the main structure of a display area of an organic EL device (hereinafter "display 600").

The display 600 is substantially composed of a circuit element part 602, a light-emitting element part 603, and a negative electrode 604 all of which are deposited on a substrate (W) 601.

In the display 600, light emitted from the light-emitting element part 603 to the substrate 601 side passes through the circuit element part 602 and the substrate 601 to be emitted to the observer side, on one hand. On the other, light emitted from the light-emitting element part 603 to the side opposite to the substrate 601 is reflected by the negative electrode 604, and then passes through the circuit element part 602 and the substrate 601 to be emitted to the observer side.

Between the circuit element part 602 and the substrate 601, a base protective film 606 made of a silicon oxide film is formed. Provided on the base protective film 606 (on the light-emitting element part 603 side) is an island-shaped semiconductor film 607 made of polycrystalline silicon. In right and left areas of the semiconductor film 607, a source region 607*a* and a drain region 607*b* are formed by the implantation of high concentrations of positive ions. A central part where no positive ion is implanted becomes a channel region 607*c*.

In the circuit element part 602, a transparent gate insulating film 608 is formed to cover the base protective film 606 and the semiconductor film 607. A gate electrode 609 made of Al, Mo, Ta, Ti, W or the like is formed at a position on the semiconductor film 607 provided on the gate insulating film 608 that is corresponding to the channel region 607*c*. On the gate electrode 609 and the gate insulating film 608, a first interlayer insulating film 611*a* and a second interlayer insulating film 611*b* that are transparent are formed. In addition, contact holes 612*a* and 612*b* are formed through the first and second interlayer insulating films 611*a* and 611*b* so as to communicate with the source region 607*a* and the drain region 607*b* of the semiconductor film 607.

On the second interlayer insulating film 611*b*, a transparent pixel electrode 613 made of ITO, etc., is patterned and formed in a predetermined shape. The pixel electrode 613 is coupled to the source region 607*a* through the contact hole 612*a*.

Provided on the first interlayer insulating film 611*a* is a power line 614, which is coupled to the drain region 607*b* through the contact hole 612*b*.

In this manner, a thin film transistor 615 for driving that is coupled to each pixel electrode 613 is formed in the circuit element part 602.

The light-emitting element part 603 is substantially composed of a functional layer 617 deposited on each of a plurality of pixel electrodes (each corresponding to the pixel electrode 613), and a bank part 618 provided between each pixel electrode 613 and the functional layer 617 to partition each functional layer 617.

The light-emitting element is composed of the pixel electrodes 613, the functional layer 617, and the negative electrode 604 provided on the functional layer 617. The pixel electrode 613 is patterned to be roughly rectangular in plan view. The bank part 618 is formed between one pixel electrode 613 and another pixel electrode 613.

The bank part 618 is composed of an inorganic bank layer 618a (first bank layer) made of an inorganic material, such as SiO, $SiO_2$ and $TiO_2$, and an organic bank layer 618*b* (second bank layer) with a trapezoidal cross section. The organic bank layer 618*b* is deposited on the inorganic bank layer 618*a* and is made of a resist with excellent heat resistance and solvent resistance, such as acrylic and polyimide resins. Part of the bank part 618 rides on the edge of the pixel electrode 613.

An opening part 619 that gradually spreads and opens upward to the pixel electrode 613 is formed between one bank part 618 and another bank part 618.

The functional layer 617 is composed of a hole injection/transport layer 617*a* deposited on the pixel electrode 613 in the opening part 619, and a light-emitting layer 617*b* formed on the hole injection/transport layer 617*a*. Here, other functional layers having other functions may be formed next to the light-emitting layer 617*b*. For example, an electron transport layer can also be formed.

The hole injection/transport layer 617*a* has a function of transporting holes from the pixel electrode 613 side and injecting them into the light-emitting layer 617*b*. The hole injection/transport layer 617*a* is formed by discharging a first composition (functional liquid) containing a hole injection/transport layer material. Note that any suitable material can be used as the hole injection/transport layer material.

The light-emitting layer 617*b* emits light of any of red (R), green (G) and blue (B), and is formed by discharging a second composition (functional liquid) containing a light-emitting layer material (light-emitting material). As a solvent of the second composition (nonpolar solvent), any suitable material which is insoluble with respect to the hole injection/transport layer 617*a* may be used. With such a nonpolar solvent used for the second composition of the light-emitting layer 617*b*, the light-emitting layer 617*b* can be formed without re-dissolving the hole injection/transport layer 617*a*.

The light-emitting layer 617*b* has a structure in which holes injected from the hole injection/transport layer 617*a* and electrons injected from the negative electrode 604 are rebonded in the light-emitting layer to emit light.

The negative electrode 604 covers the entire surface of the light-emitting element part 603, and passes a current through the functional layer 617 while making a pair with the pixel electrode 613. Here, a seal member (not shown) is arranged on the upper part of the negative electrode 604.

A process for manufacturing the display 600 will now be described referring to FIGS. 22 to 30.

Figure 22:
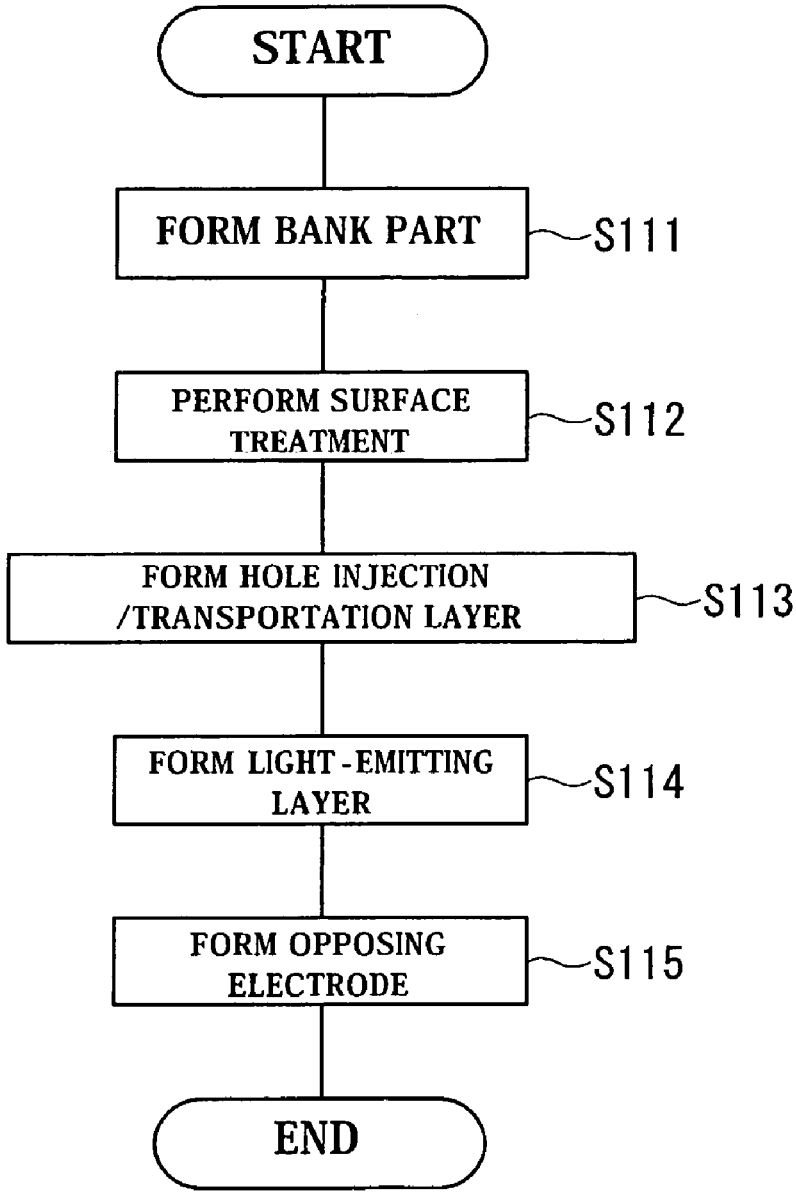
FIG. 22 is a flowchart illustrating a process for manufacturing the display that is an organic EL device.

Referring to FIG. 22, the display 600 is manufactured through steps for forming a bank part (S111), performing surface treatment (S112), forming a hole injection/transport layer (S113), forming a light-emitting layer (S114), and forming an opposing electrode (S115). The manufacturing process is not limited to this example, and any steps may be removed or added as necessary.

Figure 23:
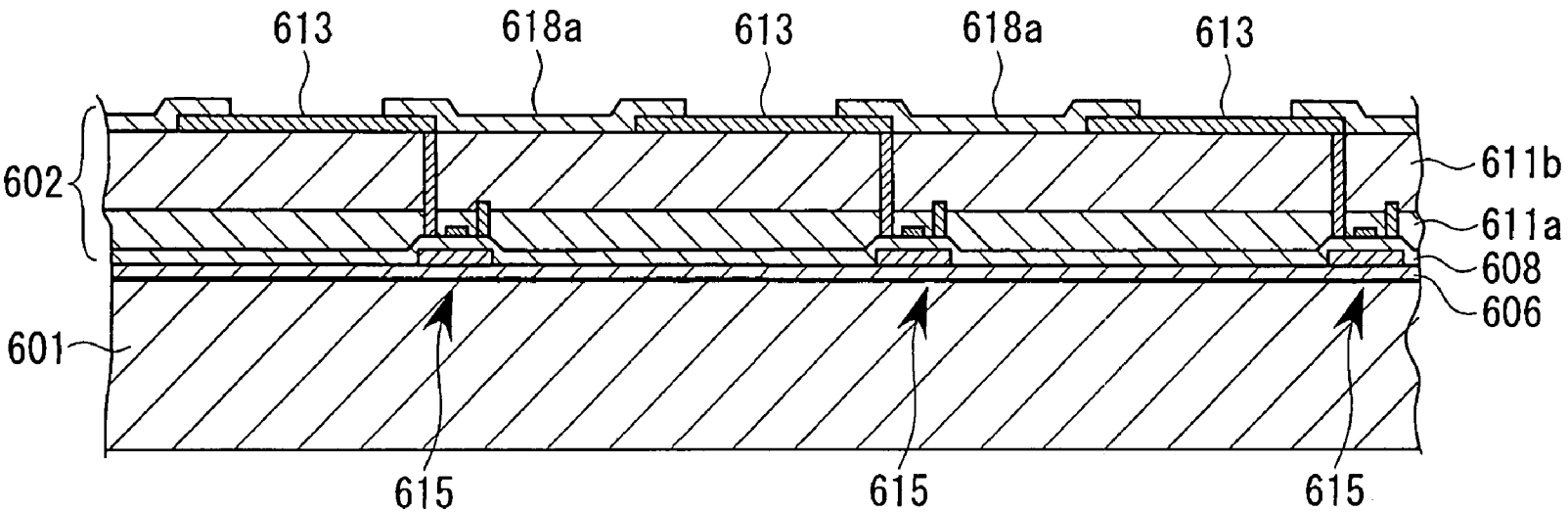
FIG. 23 is a schematic illustrating the forming of an inorganic bank layer.

Referring to FIG. 23, the inorganic bank layer 618*a* is formed on the second interlayer insulating film 611*b* in the step for forming a bank part (S111). The inorganic bank layer 618*a* is provided by forming an inorganic film at a forming position and patterning the film by a photolithography technique or the like. Here, part of the inorganic bank layer 618*a* overlaps the edge of the pixel electrode 613.

Figure 24:
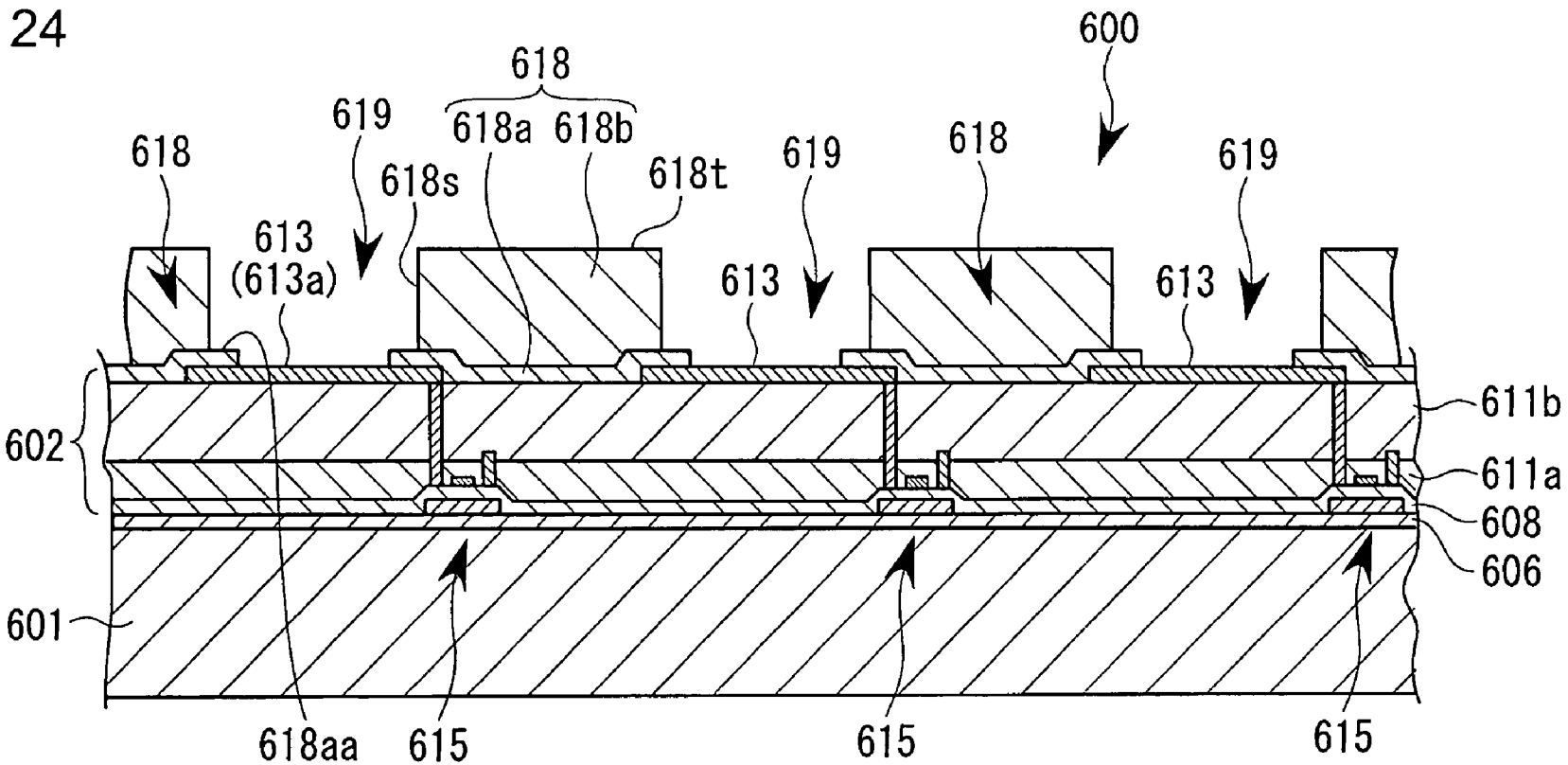
FIG. 24 is a schematic illustrating the forming of an organic bank layer.

After the inorganic bank layer 618*a* is formed, the organic bank layer 618*b* is formed on the inorganic bank layer 618*a* as shown in FIG. 24. The organic bank layer 618*b* is also formed by patterning using a photolithography technique or the like in the same manner as the inorganic bank layer 618*a*.

This way the bank part 618 is formed. Along with this, the opening part 619 that opens upward to the pixel electrode 613 is formed between one bank part 618 and another bank part 618. The opening part 619 defines a pixel area.

In the step for performing surface treatment (S112), lyophilic treatment and liquid repellent treatment are performed. Regions subjected to the lyophilic treatment are a first multi-layered part 618*a* a included in the inorganic bank layers 618*a* and an electrode surface 613*a* included in the pixel electrode 613. The surface of these regions are treated to be lyophilic by plasma treatment using oxygen as a processing gas, for example. By the plasma treatment, ITO of the pixel electrode 613 is also cleaned, for example.

The liquid repellent treatment is applied to a wall surface 618*s* included in the organic bank layer 618*b* and an upper surface 618*t* included in the organic bank layer 618*b*. For example, the surfaces are subjected to fluoridation treatment (treated to be liquid repellent) by plasma treatment using methane tetrafluoride as a processing gas.

By performing the step of surface treatment, when forming the functional layer 617 using the droplet discharge head 21, a functional-liquid droplet can be surely landed on a pixel area. Also, it is possible to reduce the likelihood or prevent a functional-liquid droplet landed on a pixel area from leaking out from the opening part 619.

The above-mentioned steps provides a display base body 600A. The display base body 600A is placed on the set table 17 of the droplet discharge unit 3 shown in FIGS. 1 and 2, and the following steps for forming a hole injection/transport layer (S113) and forming a light-emitting layer (S114) are performed.

Figure 25:
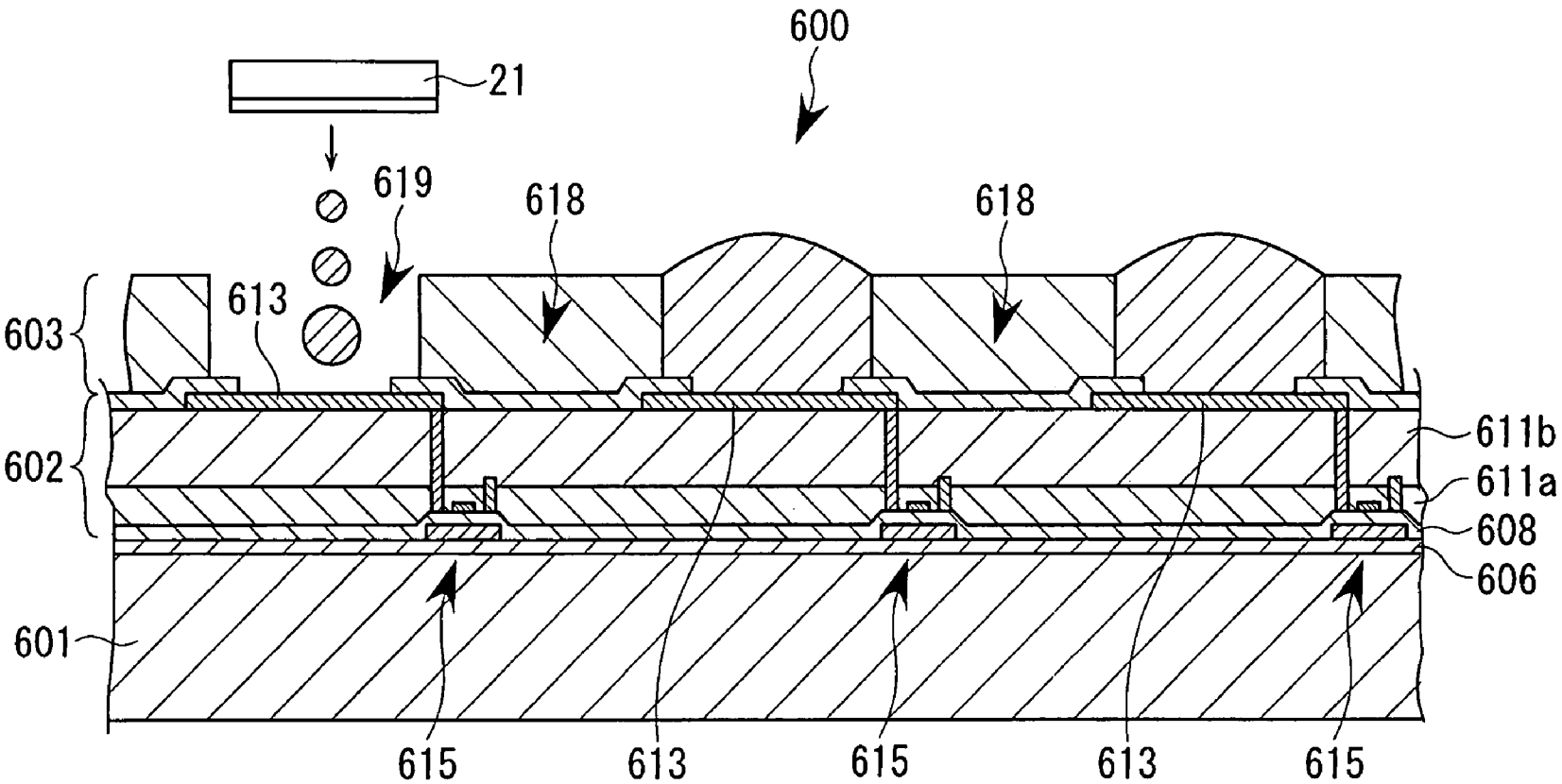
FIG. 25 is a schematic illustrating a process for forming a hole injection/transport layer.
Figure 26:
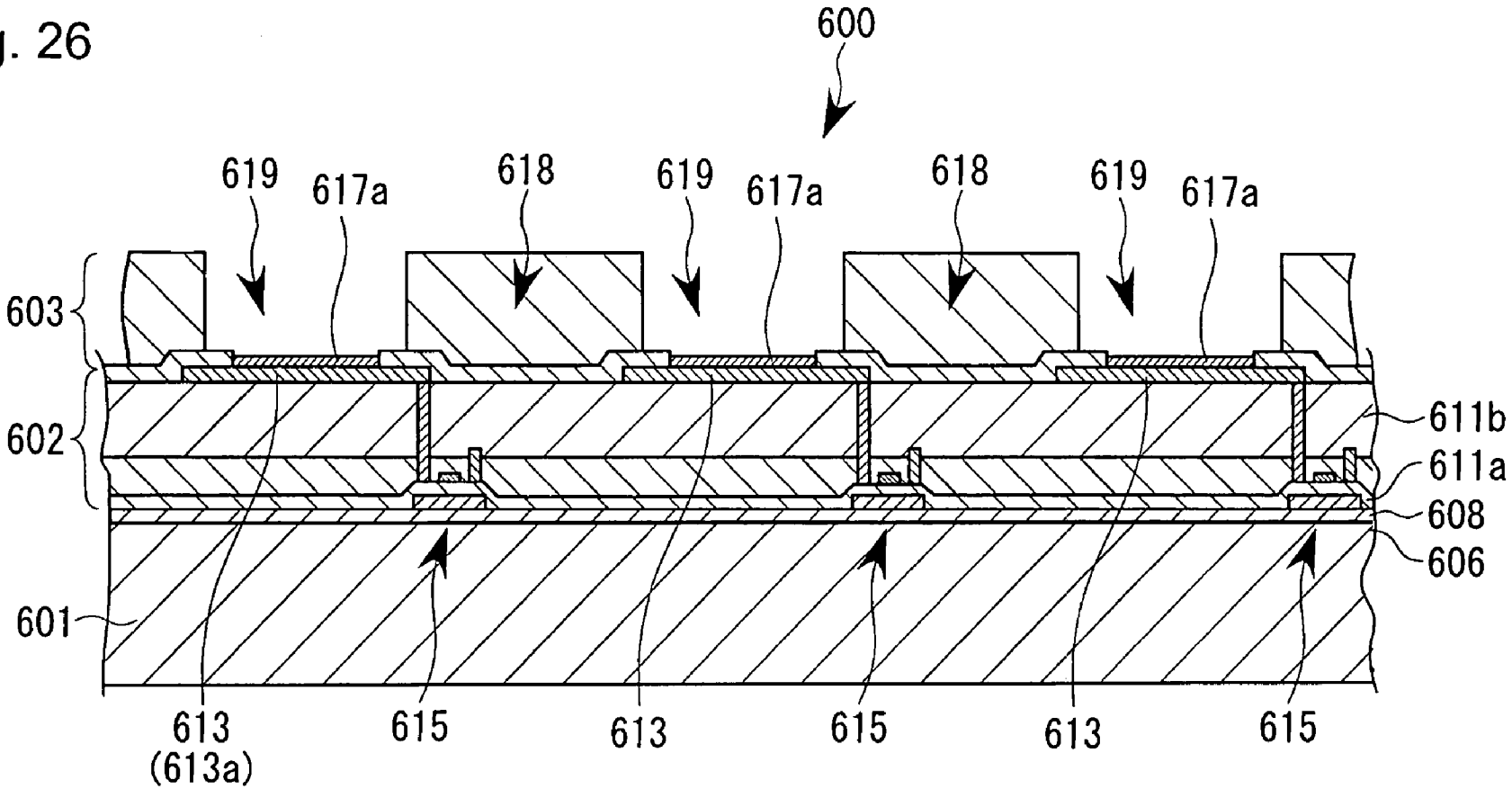
FIG. 26 is a schematic illustrating a state in which the hole injection/transport layer has been formed.

Referring to FIG. 25, the first composition containing a hole injection/transport layer material is discharged from the droplet discharge head 21 to each opening part 619, which is a pixel area, in the step for forming a hole injection/transport layer (S113). Subsequently, drying treatment and heat treatment are performed to vaporize a polar solvent contained in the first composition and to form the hole injection/transport layer 617*a* on the pixel electrode (electrode surface 613*a*) 613, as shown in FIG. 26.

The step for forming a light-emitting layer (S114) will now be described. In the step for forming a light-emitting layer, as described above, in order to reduce the likelihood or prevent the hole injection/transport layer 617*a* from being re-dissolved, a nonpolar solvent that is insoluble to the hole injection/transport layer 617*a* is used as a solvent of the second composition used to form the light-emitting layer.

However, since the hole injection/transport layer 617*a* has low affinity to the nonpolar solvent, even if the second composition containing the nonpolar solvent is discharged on the hole injection/transport layer 617*a*, there is a possibility that the hole injection/transport layer 617*a* and the light-emitting layer 617*b* cannot be brought into close contact with each other, or the light-emitting layer 617*b* cannot be evenly applied.

Therefore, in order to increase the affinity of the surface of the hole injection/transport layer 617*a* with respect to the nonpolar solvent and the light-emitting layer material, surface treatment (surface modification treatment) may be performed before forming the light-emitting layer. The surface treatment is performed by applying and drying a surface modification material that is the same solvent as or a similar solvent to the nonpolar solvent of the second composition used to form the light-emitting layer to the hole injection/transport layer 617*a*.

This treatment makes the surface of the hole injection/transport layer 617*a* become affinitive to the nonpolar solvent. Therefore, in the subsequent step, the second composition containing the light-emitting layer material can be evenly applied to the hole injection/transport layer 617*a*.

Figure 27:
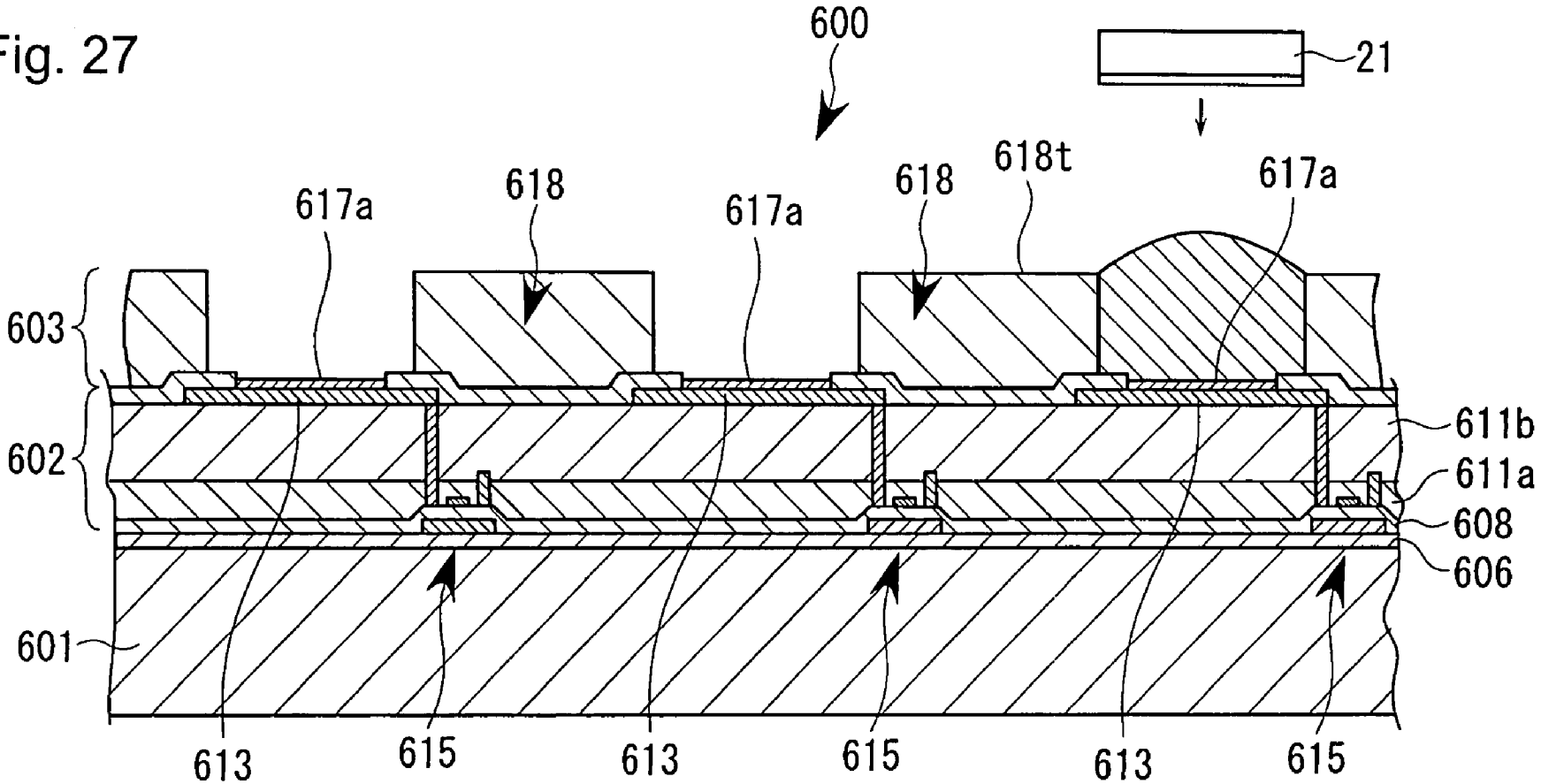
FIG. 27 is a schematic illustrating a process for forming a blue-light-emitting layer.

Next, as shown in FIG. 27, a predetermined amount of the second composition containing the light-emitting layer material corresponding to any of the colors (blue (B) in the example shown in FIG. 27) is implanted into the pixel area (an opening part 619) as a functional-liquid droplet. The second composition implanted into the pixel area spreads on the hole injection/transport layer 617*a* and fills the opening part 619. Even if the second composition deviates from the pixel area and is landed on the upper surface 618*t* of the bank part 618, since the upper surface 618*t* is subjected to the liquid repellent treatment, the second composition easily rolls into the opening part 619.

Figure 28:
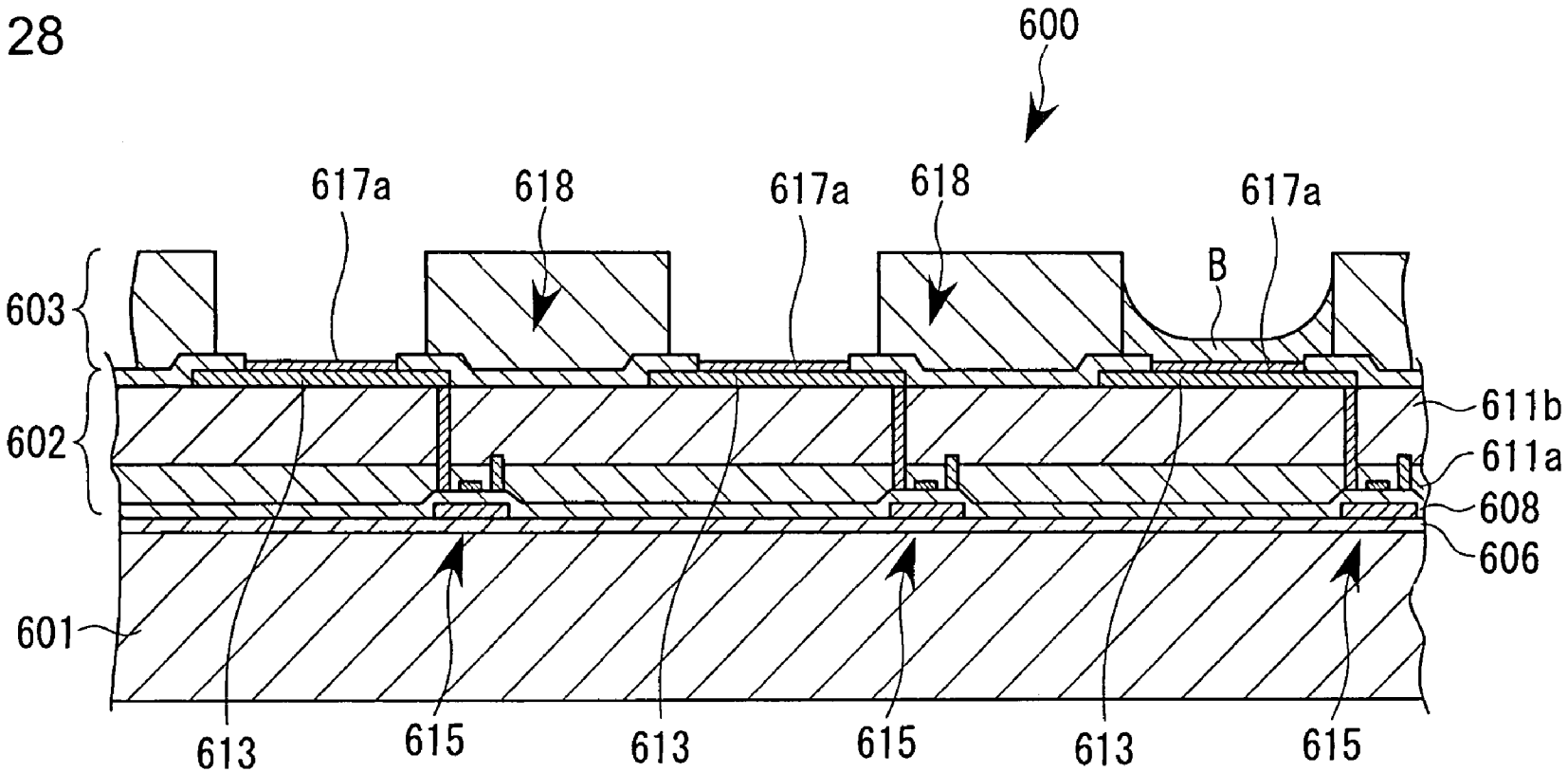
FIG. 28 is a schematic illustrating a state in which the blue-light-emitting layer has been formed.

Subsequently, by performing the drying step or the like, the second composition that has been discharged is subjected to drying treatment in order to vaporize the nonpolar solvent contained in the second composition. Accordingly, as shown in FIG. 28, the light-emitting layer 617*b* is formed on the hole injection/transport layer 617*a*. In this drawing, the light-emitting layer 617*b* of blue (B) is formed.

Figure 29:
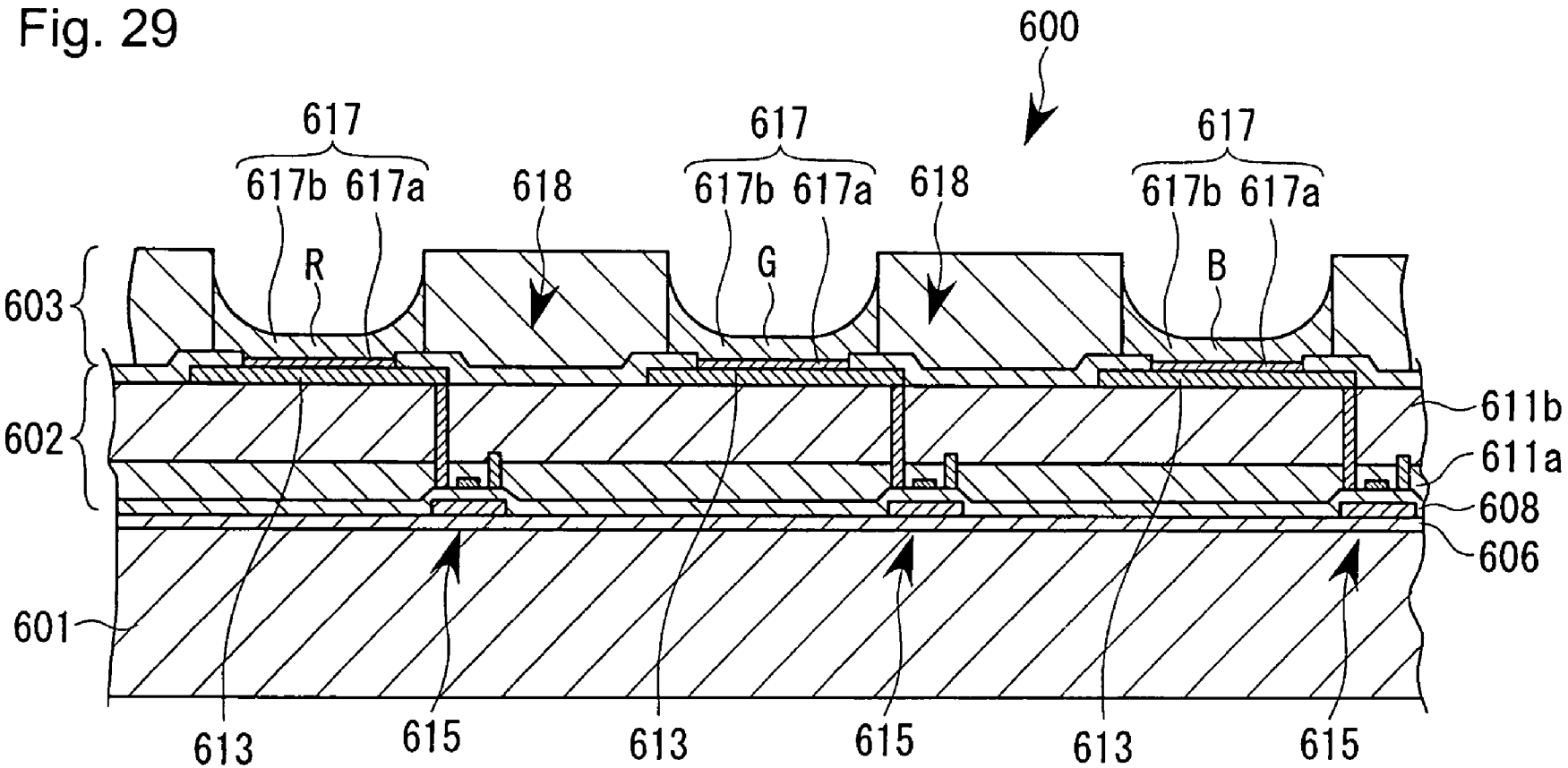
FIG. 29 is a schematic illustrating a state in which the light-emitting layer of each color has been formed.

Similarly, by using the droplet discharge head 21 as shown in FIG. 29, a similar step to the step for forming the above-mentioned light-emitting layer 617*b* of blue (B) is sequentially performed to form the light-emitting layer 617*b* of the other colors (red (R) and green (G)). The order of forming the light-emitting layer 617*b* is not limited to the exemplified order. The light-emitting layer 617*b* may be formed in any order. For example, the order can be determined according to light-emitting layer materials. The three colors, R, G, B, can be arranged in stripe, mosaic, delta, and other patterns.

As described above, the functional layer 617, that is, the hole injection/transport layer 617*a* and the light-emitting layer 617*b* are formed on the pixel electrode 613, which is followed by the step for forming an opposing electrode (S115).

Figure 30:
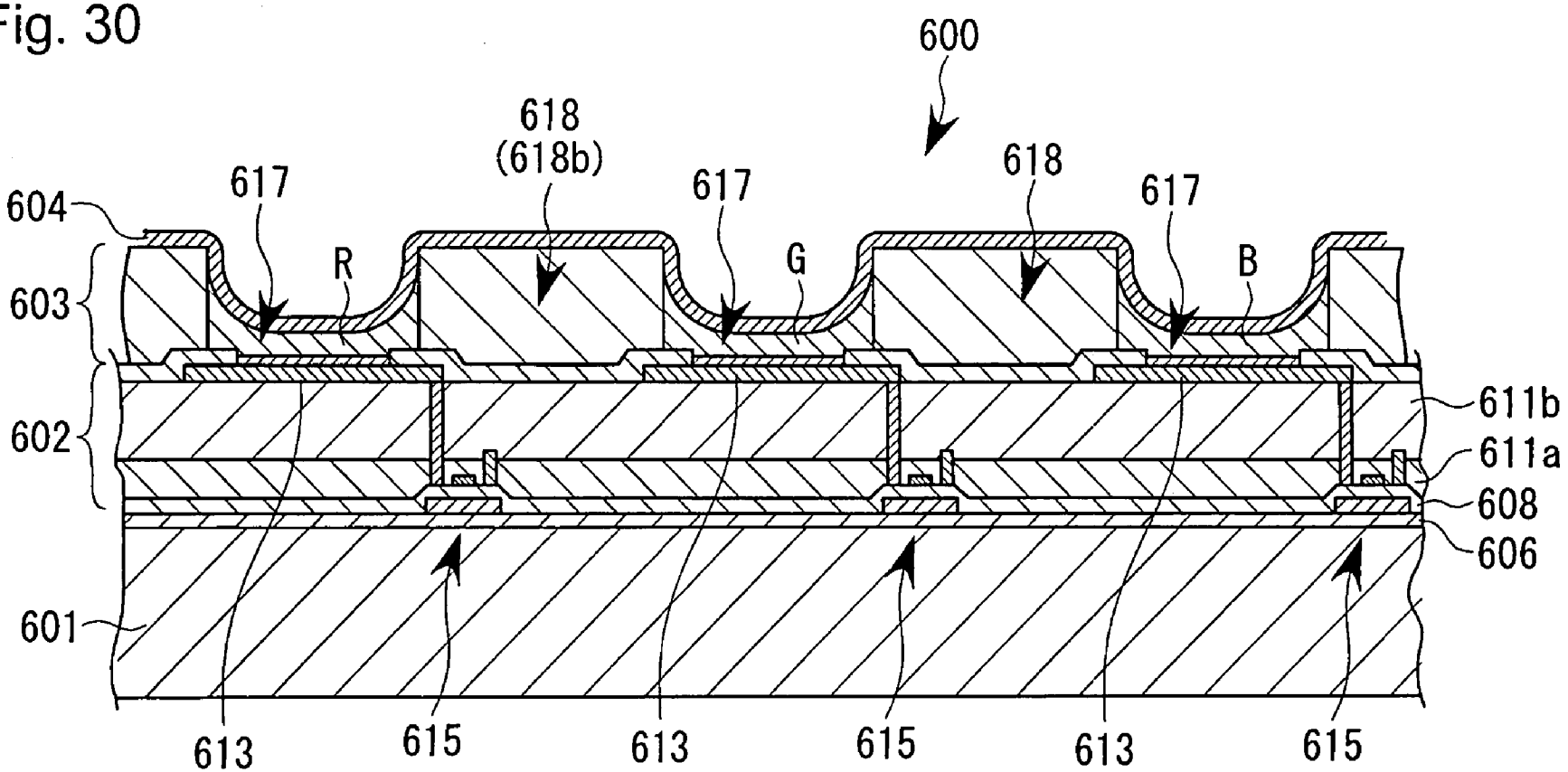
FIG. 30 is a schematic illustrating the forming of a negative electrode.

Referring to FIG. 30, the negative electrode 604 (opposing electrode) is formed on the entire surface of the light-emitting layer 617*b* and the organic bank layer 618*b* by, for example, vapor deposition, sputtering, CVD or the like in the step for forming an opposing electrode (S115). In the present exemplary embodiment, the negative electrode 604 is formed by depositing a calcium layer and an aluminum layer, for example.

On the upper part of the negative electrode 604, an Al film or an Ag film as an electrode, and a protective layer made of $SiO_2$, SiN or the like for reducing or preventing oxidation of the electrode are provided as necessary.

After the negative electrode 604 is formed in this manner, seal treatment to seal the upper part of the negative electrode 604 with a seal member, wiring process or other processes are performed, which complete the display 600.

Figure 31:
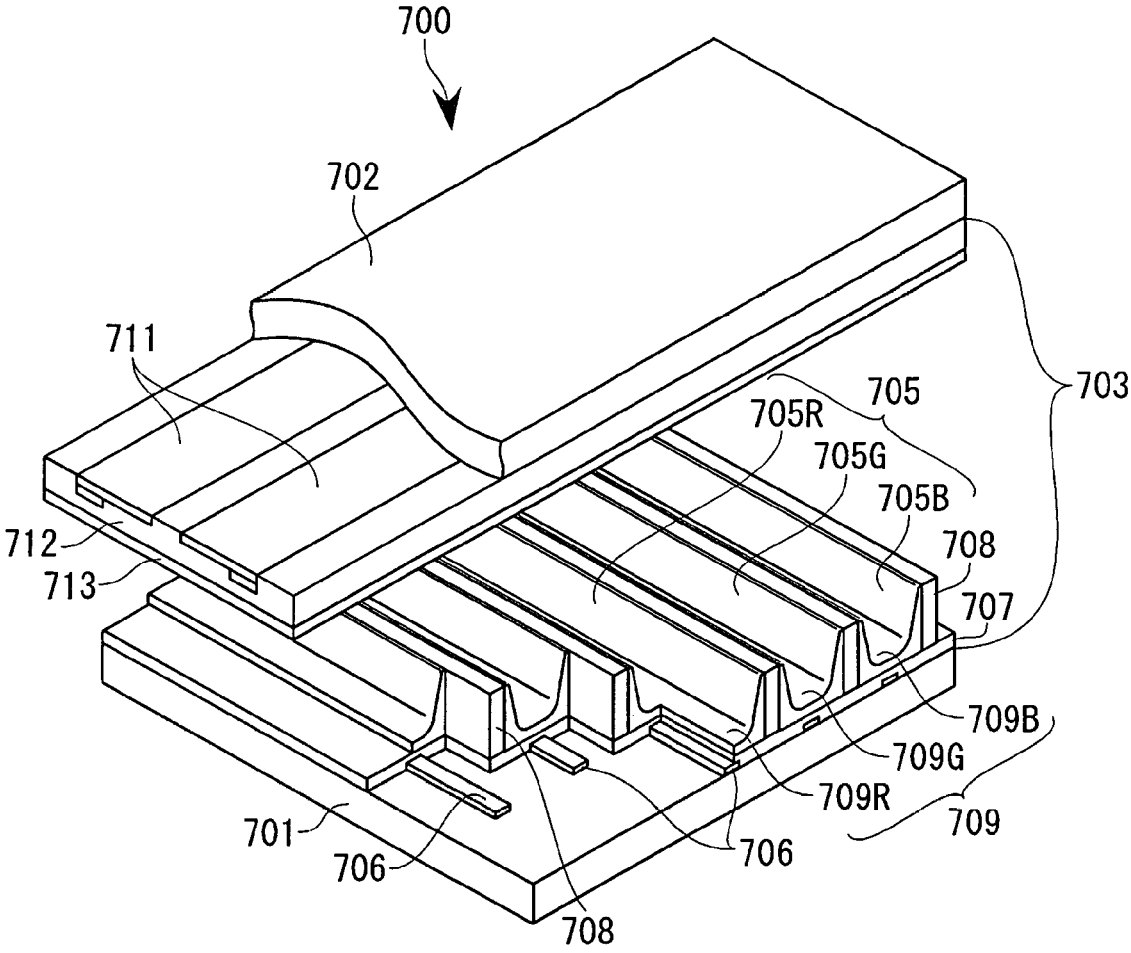
FIG. 31 is a schematic showing the main structure of a display that is a plasma display (PDP device)

FIG. 31 is a schematic showing the main structure of a plasma display (PDP device, hereinafter "display 700"). In this drawing, the display 700 is shown with a part thereof removed.

The display 700 is substantially composed of a first substrate 701 and a second substrate 702 that are arranged to be opposed to each other, and an electric discharge display part 703 that is formed between the substrates. The electric discharge display part 703 is composed of a plurality of electric discharge chambers 705. In the plurality of electric discharge chambers 705, three electric discharge chambers 705 of a red electric discharge chamber 705R, a green electric discharge chamber 705G, a blue electric discharge chamber 705B are arranged to make a set for composing a pixel.

On the upper surface of the first substrate 701, address electrodes 706 are formed in stripe at a predetermined interval. A dielectric layer 707 is formed so as to cover the upper surface of the address electrodes 706 and of the first substrate 701. On the dielectric layer 707, partition walls 708 are formed between the address electrodes 706 upright along the address electrodes 706. The partition walls 708 include walls extending in the width direction of the address electrodes 706 as shown in the drawing, and other walls (not shown) extended in the direction perpendicular to the address electrodes 706.

Areas partitioned by the partition walls 708 are the electric discharge chambers 705.

A fluorescent substance 709 is arranged inside the electric discharge chambers 705. The fluorescent substance 709 emits light of any color of red (R), green (G) and blue (B). A red fluorescent substance 709R is arranged at the bottom part of the red electric discharge chamber 705R, a green fluorescent substance 709G at the bottom part of the green electric discharge chamber 705G, and a blue fluorescent substance 709B at the bottom part of the blue electric discharge chamber 705B.

Referring to the drawing, a plurality of display electrodes 711 are formed in a direction perpendicular to the address electrodes 706 in stripes at a predetermined interval on the lower surface of the second substrate 702. In addition, a dielectric layer 712 and a protective layer 713 made of MgO or the like are formed so as to cover the display electrodes 711.

The first substrate 701 and the second substrate 702 are joined face to face in a state that the address electrodes 706 and the display electrodes 711 are placed perpendicular to each other. The address electrodes 706 and the display electrodes 711 are coupled to an AC power (not shown).

By passing a current through the electrodes 706 and 711, the fluorescent substance 709 is excited to emit light in the electric discharge display part 703, thereby providing a color display.

In the present exemplary embodiment, the address electrodes 706, the display electrodes 711, and the fluorescent substance 709 can be formed using the droplet discharge unit 3 shown in FIGS. 1 and 2. A process for forming the address electrodes 706 in the first substrate 701 will be illustrated.

In this case, the following process is performed in a state that the first substrate 701 is placed on the set table 17 of the droplet discharge unit 1.

First, a liquid material (functional liquid) containing a conductive film wiring material is landed by the droplet discharge head 21 on an address electrode forming area as a functional-liquid droplet. This liquid material is obtained by dispersing conductive fine particles of a metal, etc., in a dispersion medium as the conductive film wiring material. As the conductive fine particles, metal fine particles containing gold, silver, copper, palladium, nickel or the like, a conductive polymer or the like can be used.

After providing the liquid material to all the address electrode forming areas to be provided, the liquid material that has been discharged is dried so as to vaporize the dispersion medium contained in the liquid material. Consequently, the address electrodes 706 are formed.

While forming of the address electrodes 706 has been illustrated, the display electrodes 711 and the fluorescent substance 709 can also be formed by the above-mentioned steps.

To form the display electrodes 711, in the same manner as the forming of the address electrodes 706, a liquid material (functional liquid) containing a conductive film wiring material is landed on the display electrode forming area as a functional-liquid droplet.

To form the fluorescent substance 709, a liquid material (functional liquid) containing a fluorescent material corresponding to each of the colors (R, G, B) is discharged as a droplet from the droplet discharge head 21 to be landed on the electric discharge chambers 705 of the corresponding color.

Figure 32:
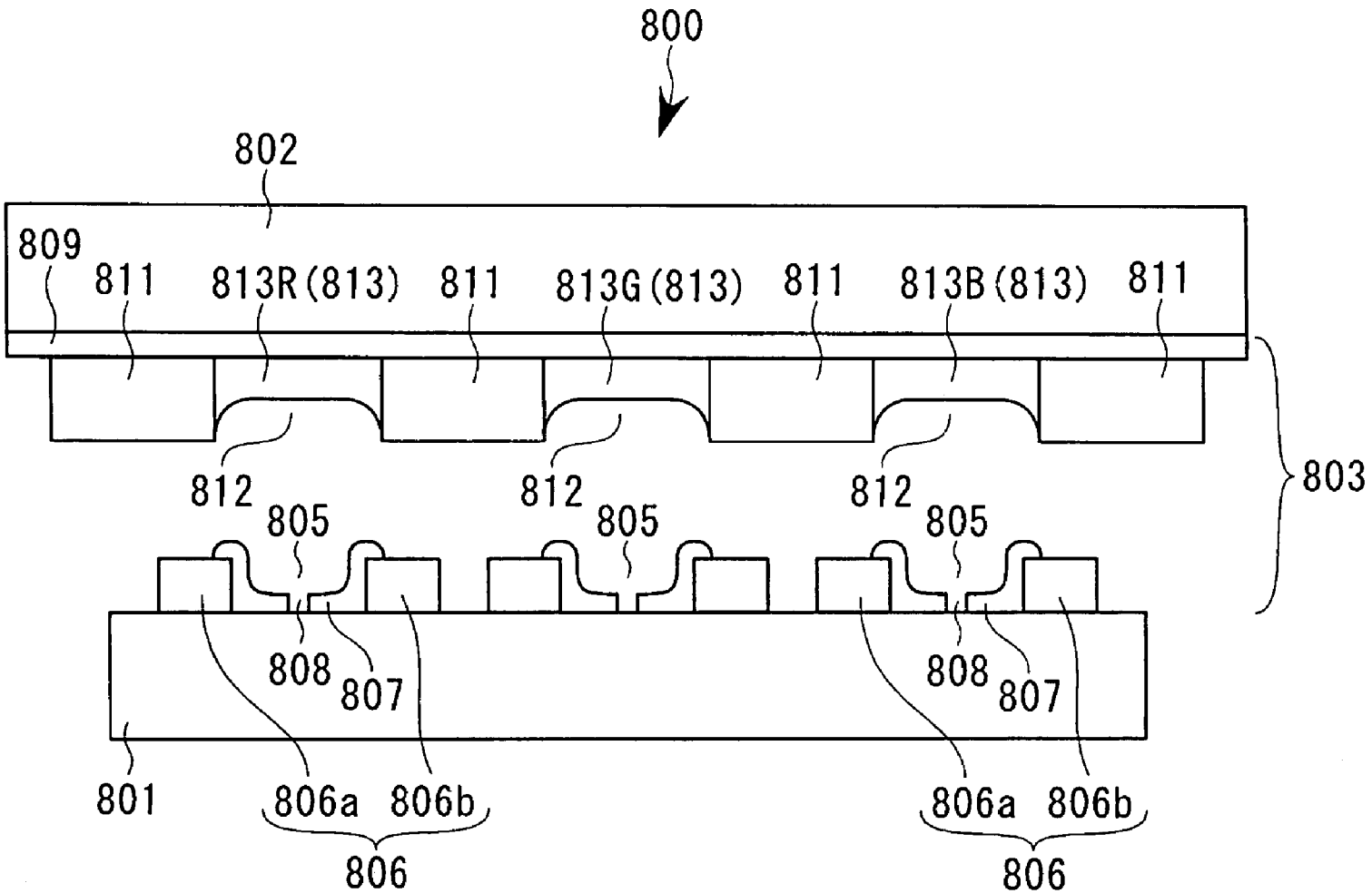
FIG. 32 is a schematic showing the main structure of a display that is an electron-emitting device (FED device.

FIG. 32 is a schematic showing the main structure of an electron-emitting device that is also called an FED device or an SED device (hereinafter referred to as a "display 800"). The drawing shows the cross section of part of the display 800.

The display 800 is substantially composed of a first substrate 801 and a second substrate 802 that are arranged to be opposed to each other, and a field emission display part 803 that is formed between these substrates. The field emission display part 803 includes a plurality of electron-emitting parts 805 arranged in a matrix.

On the upper surface of the first substrate 801, a first element electrode 806*a* and a second element electrode 806b composing a cathode electrode 806 are formed perpendicular to each other. Provided in an area partitioned by the first element electrode 806*a* and the second element electrode 806*b* is a conductive film 807 in which a gap 808 is formed. In other words, each of the plurality of electron-emitting parts 805 are composed of the first element electrode 806*a*, the second element electrode 806*b* and the conductive film 807. The conductive film 807 is composed of palladium oxide (PdO) or the like. The gap 808 is made by a forming process (for example, chemical polishing or mechanical polishing) or the like after providing the conductive film 807.

Provided on the lower surface of the second substrate 802 is an anode electrode 809 placed face to face with the cathode electrodes 806. Provided on the lower surface of the anode electrode 809 is a bank part 811 in a lattice. In each downward opening part 812 surrounded by the bank part 811, a fluorescent substance 813 is arranged correspondingly to the electron-emitting parts 805. Each fluorescent substance 813 emits fluorescence of any of red (R), green (G) and blue (B). In each opening part 812, a red fluorescent substance 813R, a green fluorescent substance 813G or a blue fluorescent substance 813B is arranged in the above-mentioned predetermined pattern.

The first substrate 801 and the second substrate 802 formed as mentioned above are joined to each other with a minute gap therebetween. In the display 800, electrons flying out from the first element electrode 806*a* or the second element electrode 806*b*, which are negative electrodes, through the conductive film (gap 808) 807 hit the fluorescent substance 813 formed in the anode electrode 809, which is a positive electrode, so that the fluorescent substance 813 is excited to emit light, thereby providing a color display.

In this case as well as the other exemplary embodiments, the first element electrode 806*a*, the second element electrode 806*b*, the conductive film 807 and the anode electrode 809 are formed by using the droplet discharge unit 3. Also, the fluorescent substances 813R, 813G, 813B can be formed by using the droplet discharge unit 3.

Figure 33A:
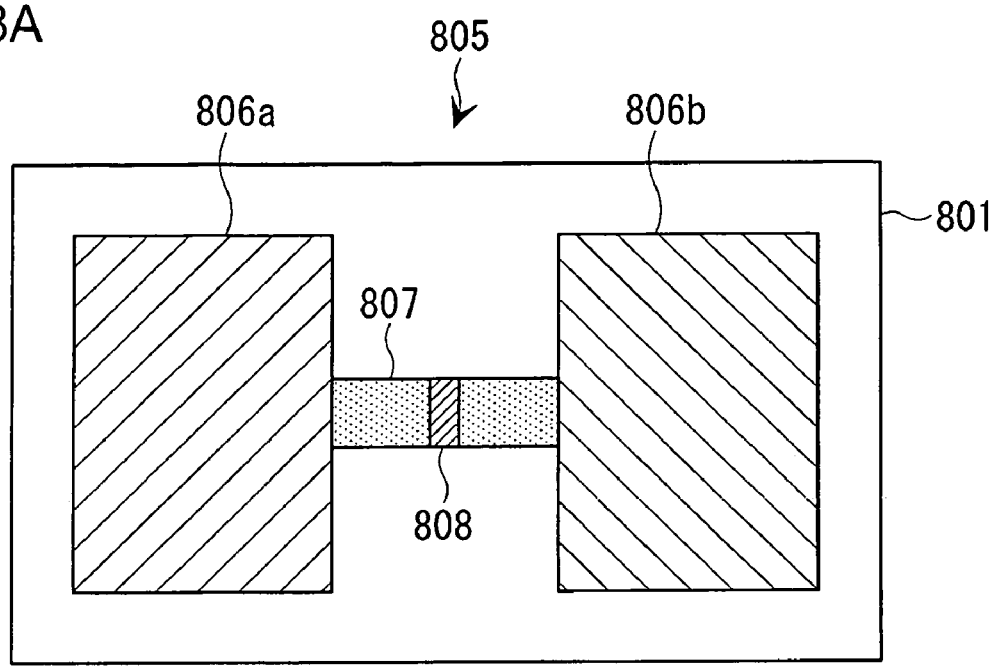
FIG. 33A is a schematic around an electron-emitting part of a display.
Figure 33B:
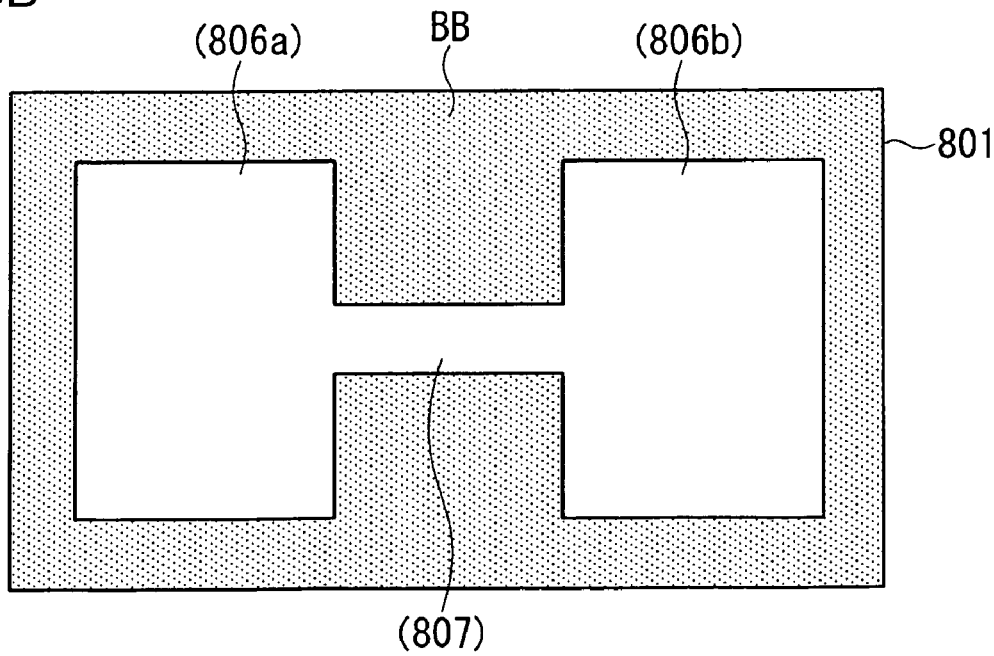
FIG. 33B is a schematic showing a forming method thereof.

The first element electrode 806*a*, the second element electrode 806*b* and the conductive film 807 have such a plane shape as shown in FIG. 33A. When forming these films, a bank part BB is formed (by photolithography) while leaving space to form the first element electrode 806*a*, the second element electrodes 806*b* and the conductive films 807 as shown in FIG. 33B in advance. Next, the first element electrode 806*a* and the second element electrode 806*b* are formed in groove parts constructed by the bank part BB (by ink jetting by the droplet discharge unit 3). After drying their solvent to form their films, the conductive film 807 is formed (by ink jetting by means of the droplet discharge unit 3). The forming of the conductive film 807 is followed by the removal of the bank part BB (by ashing peeling), and then the above-mentioned forming process (for example, chemical polishing or mechanical polishing). Lyophilic treatment for the first substrate 801 and the second substrate 802 and liquid repellent treatment for the bank part 811 and BB may also be performed like in the above-mentioned organic EL device.

Examples of other electro-optical devices may include metal wiring forming, lens forming, resist forming, and light diffuser forming devices. Using the droplet discharge unit 3 makes it possible to efficiently manufacture various electro-optical devices.

What is claimed is:

1. A wiping device, comprising:

a wiping sheet that wipes a nozzle surface of a droplet discharge head;

a cleaner sprayer that sprays and applies a cleaner to an applied area on a front surface of the wiping sheet prior to the wiping;

a charged electrode that electrically charges a cleaner sprayed by the cleaner sprayer; and an absorption electrode that is provided on a back surface of the wiping sheet and corresponds to the charged electrode.

2. The wiping device according to claim 1, further comprising:

static eliminator that eliminates a static charge from the wiping sheet to which a cleaner is applied so as to prevent a nozzle surface of the droplet discharge head from being electrically charged.

3. The wiping device according to claim 1, a width of the absorption electrode being slightly smaller than a sheet width of the wiping sheet.

4. The wiping device according to claim 1, the absorption electrode being separated into a plurality of partial electrodes to each of which a voltage is applied individually.

5. The wiping device according to claim 1, the charged electrode being roughly ring shaped surrounding a cleaner that has been sprayed.

6. A droplet discharge unit, comprising:

the wiping device according claim 1;

a droplet discharge head that discharges a functional-liquid droplet to a work; and an X-Y moving mechanism that relatively moves a work to the droplet discharge head in an X-axis direction and a Y-axis direction.

7. An electro-optical device, comprising:

a film-forming part is provided by discharging a functional-liquid droplet to a work from the droplet discharge head by using the droplet discharge unit according to claim 6.

8. A method for manufacturing an electro-optical device, comprising:

discharging a functional-liquid droplet to a work from the droplet discharge head so as to provide a film-forming part by using the droplet discharge unit according to claim 6.

9. Electronic equipment, comprising:

the electro-optical device according to claim 7.

10. Electronic equipment, comprising:

an electro-optical device manufactured by the method for manufacturing of an electro-optical device according to claim 8.

* * * * *